US006654705B1

(12) United States Patent
Benson et al.

(10) Patent No.: US 6,654,705 B1
(45) Date of Patent: Nov. 25, 2003

(54) SYSTEM FOR DETECTING A SURFACE CONTOUR OF THE HUMAN FOOT

(76) Inventors: Joel W. Benson, 19 Westwood La., Lincolnshire, IL (US) 60069; John T. Wellehan, 1220 N. LaSalle, Apt. 2H, Chicago, IL (US) 60657

( * ) Notice: Subject to any disclaimer, the term of this patent is extended or adjusted under 35 U.S.C. 154(b) by 0 days.

(21) Appl. No.: 09/414,456

(22) Filed: Oct. 7, 1999

(51) Int. Cl.[7] ..... G01B 7/00
(52) U.S. Cl. ..... 702/168; 702/152
(58) Field of Search ..... 702/166–168, 702/170, 179, 187, 150, 152, 155

(56) References Cited

U.S. PATENT DOCUMENTS

| | | | | |
|---|---|---|---|---|
| 2,010,407 A | | 8/1935 | Matthias | |
| 2,162,916 A | | 6/1939 | Hyland | |
| 2,230,143 A | | 1/1941 | Hyland | |
| 2,323,539 A | | 7/1943 | Hyland et al. | |
| 2,330,317 A | | 9/1943 | Stewart | |
| 3,696,456 A | | 10/1972 | Dunham et al. | |
| 4,153,998 A | * | 5/1979 | McMurtry | 33/556 |
| 4,279,080 A | * | 7/1981 | Nakaya | 33/561 |
| 4,449,264 A | | 5/1984 | Schwartz | |
| 4,454,618 A | | 6/1984 | Curchod | |
| 4,510,636 A | | 4/1985 | Phillips | |
| 4,517,696 A | | 5/1985 | Schartz | |
| 4,604,807 A | | 8/1986 | Bock et al. | |
| 4,679,331 A | | 7/1987 | Koontz | |
| 4,745,290 A | | 5/1988 | Frankel et al. | |
| 4,817,222 A | | 4/1989 | Shafir | |
| 4,858,621 A | | 8/1989 | Franks | |
| 4,876,758 A | | 10/1989 | Rolloff et al. | |
| 4,972,597 A | * | 11/1990 | Kadosaki et al. | 33/558 |
| 5,025,476 A | | 6/1991 | Gould et al. | |
| 5,102,223 A | | 4/1992 | Uesugi et al. | |
| 5,128,880 A | | 7/1992 | White | |
| 5,195,030 A | | 3/1993 | White | |
| 5,206,804 A | | 4/1993 | Thies et al. | |
| 5,216,594 A | | 6/1993 | White et al. | |
| 5,231,723 A | | 8/1993 | White et al. | |
| 5,237,520 A | | 8/1993 | White | |
| 5,361,133 A | | 11/1994 | Brown et al. | |
| 5,449,256 A | | 9/1995 | Sundman | |
| 5,539,677 A | | 7/1996 | Smith | |
| 5,640,779 A | | 6/1997 | Rolloff et al. | |
| 5,689,446 A | | 11/1997 | Sundman et al. | |
| 5,711,607 A | * | 1/1998 | Bernstein | 374/179 |

FOREIGN PATENT DOCUMENTS

| | | |
|---|---|---|
| CH | 172 972 | 2/1935 |
| CH | 190 837 | 5/1937 |
| DE | 596 762 | 3/1932 |
| DE | 2 308 062 | 8/1973 |
| DE | 2 821 247 | 11/1979 |

* cited by examiner

*Primary Examiner*—Marc S. Hoff
*Assistant Examiner*—Craig Steven Miller
(74) *Attorney, Agent, or Firm*—Brinks Hofer Gilson & Lione

(57) ABSTRACT

A method and apparatus for sensing the surface contour of the human foot uses an array of sensing pins that are resiliently biased in an extended position by springs. As a foot is pressed down on the pins, a counter counts decrements of vertical movement and therefore generates a count state that corresponds to the relative displacement of the foot in relation to the pins. As each pin contacts the surface of the foot, a control mechanism automatically stores the relative displacement position at which the pin is touched by the foot. These stored values provide a digital representation of the sensed contour of the foot. This digital data may be used to provide a contour image of the foot or select or manufacture shoes or shoe inserts. The contour data may also be used to obtain medical information concerning the shape of the foot.

72 Claims, 14 Drawing Sheets

Fig. 5
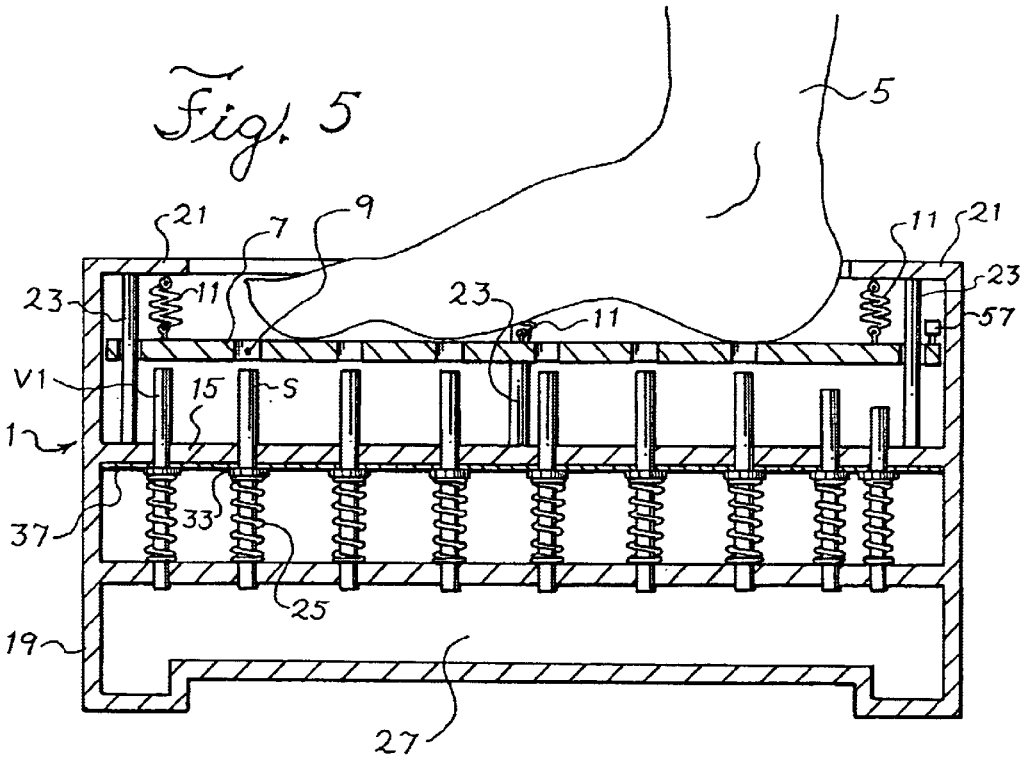
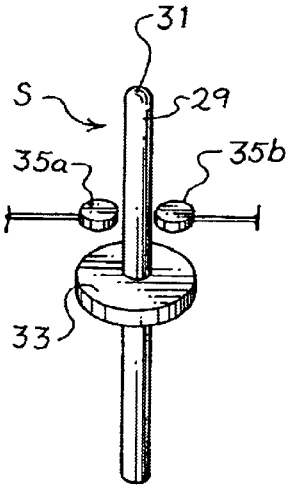
Fig. 6
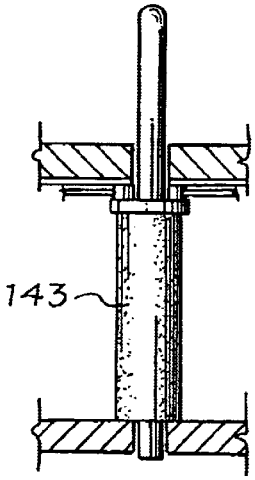
Fig. 16
Fig. 17
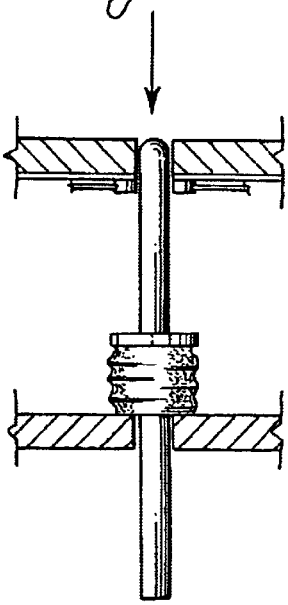

DISPLAY
MEMORY
COMPUTER
OUTPUT REGISTER
LOCAL DISPLAY
MANUFACTURING APPARATUS
SET MEMORY PIN S1
MEMORY PIN SN
SENSING PIN S1
SENSING PIN SN
RESET UP COUNTER
ONESHOT
RESET
SET
FF
VERTICAL DISPLACEMENT PIN V1
VERTICAL DISPLACEMENT PIN SN
INITIAL CONDITION SWITCH

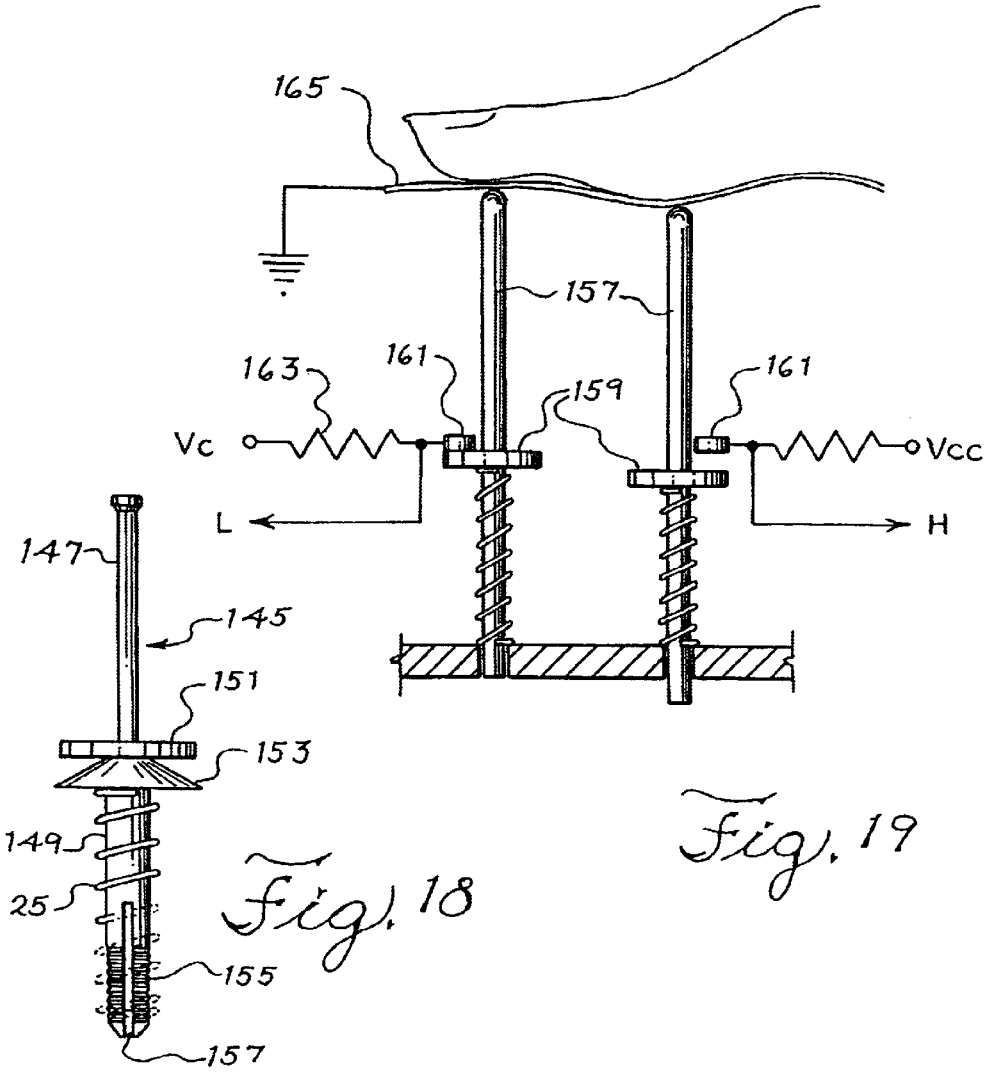
Fig. 18
Fig. 19
Fig. 20
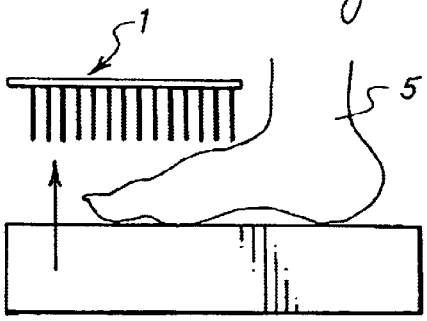
Fig. 21
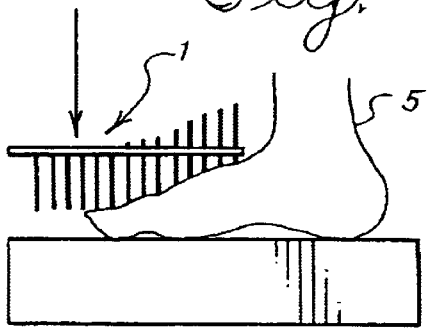

SYSTEM FOR DETECTING A SURFACE CONTOUR OF THE HUMAN FOOT

BACKGROUND OF THE INVENTION

1. Technical Field of the Invention

The invention concerns an apparatus and method for generating a digital representation of the contour of surfaces of the human foot and using this information to manufacture custom shoes and shoe inserts or select a proper fitting shoe or insert from inventory.

2. Description of the Related Art

It has long been recognized that a digital representation of a surface of the human foot may be obtained by sensing the positions of an array of resiliently biased gauging pins that make an impression of the foot as it is pressed against the pins. The relative displacement of each pin is measured by mechanisms that generate digital signals which define a contour or profile of the surface of the foot. Such systems have typically used a separate sensor to measure the displacement of each pin after it is engaged with the foot. It has been suggested that the data collected by such systems can be used to manufacture custom shoes or shoe inserts that match the contour of the foot or select shoes or inserts from inventory. The digital data has also been used to provide computer display images of the surface contour of the underside of the foot.

In one known system, magnetic pins are raised up to meet the underside of the foot and are resiliently supported by a flexible air-biased diaphragm so that they are displaced as the foot presses against them. The pins are locked in position after the foot has formed an impression by displacing them. A stepping motor incrementally moves hall-effect scanning elements which sense the displaced positions of the magnetic pins. The position of each pin is then determined by an analytical process that requires averaging arrays of data obtained for the incremental vertical steps of the scanning elements.

More recently, a foot scanner has used cameras to detect the displacement of an array of gauge pins that are locked in place to retain the impression of the foot. The images are analyzed by computer software in order to generate a digital representation of the surface of the foot.

Capacitive sensors have also been employed to detect the displacement of gauging pins. It has also been suggested that an image of the underside of the foot can be obtained by scanning the bottom of the foot with light.

The methods of these known systems tend to complicate the process for obtaining contour information. Such systems are also quite expensive in view of the complex machinery and computer analysis required to obtain a contour.

It would therefore be desirable to provide a contour sensing apparatus that does not require individual position sensors to detect the final deflected positions of an array of pins. It would also be advantageous to provide a system that employs relatively inexpensive, reliable and simple mechanisms and procedures for obtaining contour information. It would also be advantageous to provide a system with relatively simple computational requirements, for example as would be employed by an inexpensive microcontroller.

These and other advantages are achieved by the system of the invention which employs gauging or sensing pins in a relatively simple and effective manner. The system of the invention can detect the contour of the foot or any other object quickly and with minimal expense for hardware and software.

BRIEF SUMMARY OF THE INVENTION

The invention concerns a method and apparatus for measuring the contour of any object, including the human foot. The system of the invention employs gauging or sensing pins that are resiliently supported in a holder and moved to engage the surface of an object. A relative displacement for each pin is detected at the time the pin initially contacts the surface. In operation, as the surface touches and actuates a pin, the relative displacement of the actuated pin is detected and the displacement value at that point is stored. Sensing of these displacement values continues until relative displacements of all actuated pins have been stored. These stored values define the contour of the surface.

The digital contour information obtained from the system of the invention can be used to manufacture or select shoes and inserts for shoes if the sensed object is the human foot. Shoe size, shoe purchases and other demographic information for the purchaser of shoes can be collected in a database and used to assist individuals in selecting shoes. Other favorable results can be achieved if the surfaces of other objects are sensed.

BRIEF DESCRIPTION OF THE DRAWINGS

FIG. 5 is a partial cross-sectional view of a housing taken along a line 5—5 of FIG. 4 with some of the sensing pins in their fully extended positions.

FIG. 6 is a perspective view of one of the sensing pins of FIG. 5 with its associated switch contacts.

FIG. 16 is a partial cross-sectional view of a sensing pin that uses a resilient foam rubber insert as a bias element.

FIG. 17 is a partial cross-sectional view of the pin of FIG. 16 in its fully deflected position.

FIG. 18 is a side view of another embodiment of a sensing pin.

FIG. 19 is a partial cross-sectional view of another embodiment of a sensing pin.

FIG. 20 is a diagrammatic side view of the human foot in relation to a downwardly facing sensing apparatus in accordance with the invention.

FIG. 21 is a diagrammatic side view of the sensing apparatus of FIG. 20 engaged with a top surface of the foot.

DETAILED DESCRIPTION OF THE INVENTION

Figure 1:
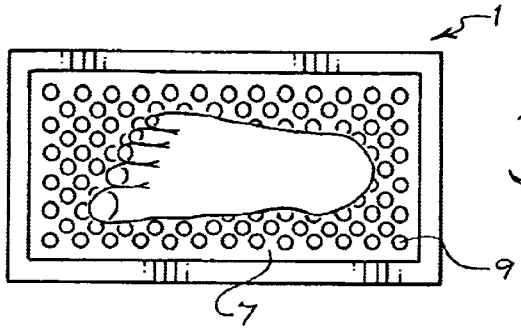
FIG. 1 is a diagrammatic illustration of a top view of one embodiment of an apparatus according to the invention which uses pins to sense the contour of the underside of the foot.
Figure 2:
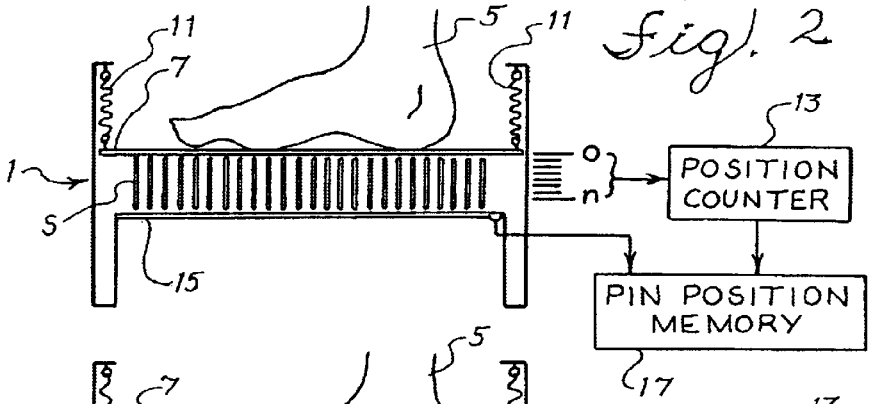
FIG. 2 is a diagrammatic illustration of a side view of the contour sensing apparatus of FIG. 1 just prior to engaging a foot with the underlying sensing pins.

In the drawings, illustrated elements are not necessarily drawn to scale, and the same reference numbers designate like elements in several views. FIG. 1 shows a diagrammatic top view of a contour sensor 1 that employs an array of sensing or gauging pins (not shown). FIG. 2 illustrates a diagrammatic cross-sectional side view of the sensing apparatus of FIG. 1 and of sensing pins S with free ends that lie in a sensing plane. As shown in FIG. 2, a human foot 5, either bare or wearing a thin, flexible sock, is initially pressed against an underlying plate 7 that has holes 9 (shown in FIG. 1) in alignment with the underlying sensing pins S. The plate 7 supports the foot 5 and, as the foot is pressed down, the underlying pins S pass through the holes 9 in the plate and contact the underside of the foot. The plate 7 is biased upward by springs 11 so that it provides some resistance to the downward movement of the foot. This resistance ensures that the foot will splay out in a normal manner as it would in a shoe as the plate 7 is pressed down toward the sensing pins S.

Figure 3:
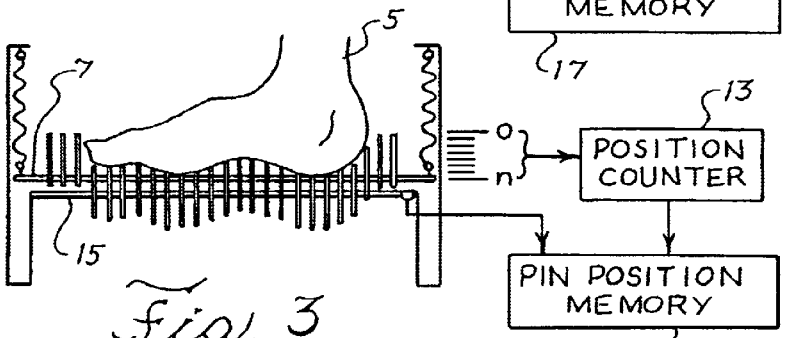
FIG. 3 is a diagrammatic illustration of a side view of the apparatus of FIG. 2 after the foot has been pressed into engagement with the sensing pins.

FIG. 3 illustrates the apparatus of FIGS. 1 and 2 with the foot 5 and its associated plate 7 pressed down sufficiently so that all of the pins underlying the foot are deflected to form an impression of the foot. The pins are resiliently supported, for example by coil springs (not shown), which are sufficiently weak to enable the foot to leave an impression easily by displacing the pins. As shown in FIG. 3, the pins that do not underlie the foot will remain in their fully extended positions.

FIGS. 2 and 3 illustrate a simple block diagram of a control system that can easily and inexpensively detect the contour of the foot. As shown in these figures, a position counter 13 records the downward movement of the plate 7 from a position just above the fully extended pins S to the position shown in FIG. 3.

In the system of FIGS. 2 and 3, an electrical signal is generated for each downward decremental movement of the plate 7 from its zero reference position at the sensing plane of the pins S. Thus, when the plate moves downward from its zero reference start position (indicated by the relatively long line adjacent the "0" notation) to the first short line decrement, an electrical signal is generated and applied to increment the position counter 13. The position counter 13 was previously reset to zero, so the first incrementing signal results in a count of one.

As the plate 7 continues to move downward, an electrical signal is generated for each decremental movement and the position counter continues to count. The count state of the counter 13 therefore indicates the magnitude of the displacement of the plate 7 from its initial zero reference position and the corresponding decrease in the distance between the plate 7 and an underlying support surface 15.

As the plate 7 continues to move downward from its initial position illustrated at FIG. 2, the underlying pins pass through the aligned holes in the plate and touch the undersurface of the foot 5. When each pin initially contacts the foot, an electrical signal is generated and the count of the position counter 13 at that point is stored at a location assigned to the pin in a memory 17. When the foot has fully deflected all of its underlying pins, the pin position memory 17 stores the count at which each pin first contacted the underside of the foot. The memory entries for the remaining undeflected pins contain a predefined maximum count to indicate that these pins were not deflected.

The stored count values therefore correspond to the relative vertical displacement or height of the ends of the pins as they are deflected to accommodate the contour of the underside of the foot. Thus, for example, the pins that are initially deflected have a relatively low associated count to indicate a minimal vertical height or displacement when the impression of the foot is made. Likewise, the pins that were actuated later in the sensing process, for example the pins adjacent the arch of the foot, have a greater displacement and an associated greater corresponding count. The unactuated pins have the greatest count and associated relative displacement or vertical height because they were not moved.

The relatively simple and straightforward sensing method of FIGS. 1–3 is employed in the detailed embodiments that are discussed hereinafter. This method does not require a direct measurement of the displacement of the pins underlying the foot. All that is required is to store the relative displacements recorded by a counter as each pin is actuated by contact with the foot.

Figure 4:
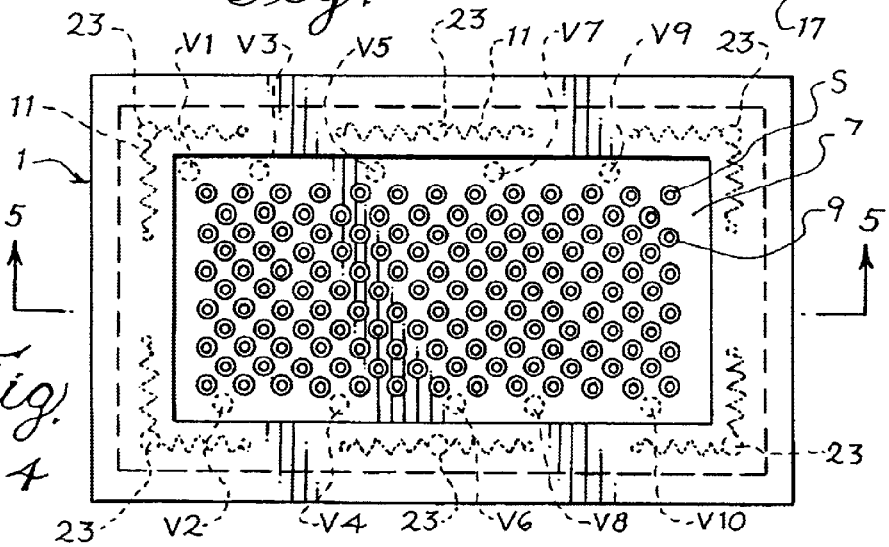
FIG. 4 is a more detailed top view of the apparatus of FIG. 1 with the foot removed.

FIGS. 4 and 5 illustrate the contour sensor of FIGS. 1–3 in greater detail. FIG. 4 is a top view of the contour sensor. As shown in FIG. 4, the sensor has a plate 7 with holes 9 that are aligned with underlying sensing pins S. FIG. 5 illustrates a partial cross-sectional view of a housing 19 in association with some sensing pins S. The holes and underlying pins shown in FIG. 4 are only for illustrative purposes. In practice, 100 or more pins may be used, depending upon the degree of resolution and the size of the area required for sensing the contour of the foot.

Also as shown in FIG. 4, the sensing pins S are arranged in an array of contiguous rows and columns. The pins are arranged in alternate offset rows as shown to facilitate sensing of the foot. Alternatively, the pins could be arranged in even rows and columns or in any other configuration suitable for collecting contour data, for example a circular configuration. An experimental device was constructed with 138 pins arranged in offset rows as shown in FIG. 4, with 13 rows of 6 pins interleaved with 12 rows of 5 pins. This number of pins appears to be sufficient to provide a reasonable area of coverage and resolution, consistent with a relatively low cost. More sensing pins or fewer sensing pins could be used without departing from the invention.

In the interest of clarity and simplicity, only a few of the sensing pins S are illustrated in the partial cross-sectional view of FIG. 5. As shown in this view, the plate 7 is suspended from a top portion 21 of the housing by springs 11 that bias the plate 7 against downward movement. The plate 7 is guided in its movement by vertical metal or plastic posts 23 that pass through associated guide holes drilled or otherwise formed in the plate. The plate 7, for example, may be made of relatively rigid plastic or metal that does not unduly deflect in response to pressure from the foot 5.

Each of the pins S of FIG. 5 is biased to its fully extended position by a coil spring 25. This spring must be sufficiently strong to return the pin to its illustrated rest position, but sufficiently weak to allow the foot to easily depress the pin without pain or harm to the skin. It has been determined that springs made from steel wire having a diameter of about 0.013 inch (0.033 cm) have bias characteristics suitable for this application. As an example, such a spring with a coil diameter of about 0.3125 inch (0.7938 cm), a length of about 1.5 inch (2.81 cm) and 12 coils or turns is well suited to this application. It should be understood that less than 12 coils are illustrated for the springs of FIG. 5 in order to simplify the illustration and facilitate an understanding of the invention. Other sizes, dimensions and materials for coil springs could be used without departing from the invention. For example, smaller diameter springs could be used to enable closer spacing of the pins.

The contour sensor 1 illustrated in FIGS. 4 and 5 operates in the manner discussed with respect to the diagrammatic illustrations of FIGS. 1–3. Thus, the structure of FIG. 5 includes the support surface 15 that was previously described. Also as previously described, the foot 5 presses the plate 7 downward against the bias force of the springs 11 and, as the plate moves downward, the ends of the sensing pins S extend through holes 9 of the plate and contact the undersurface of the foot 5.

The housing 19 of the contour sensor 1 includes a space 27 underneath the sensing pins S that is dimensioned to receive the bottom ends of the pins as they are pressed downward after contacting the surface of the foot 5. The housing 19 could be constructed without this enclosed bottom space 27. However, if the bottom space is exposed, it is possible that dirt or other debris could accumulate and interfere with the operation of the springs. It is therefore preferred to enclose the space beneath the pins. This space could also be used to contain an air bladder for biasing the pins upward in place of or in addition to the springs.

FIG. 6 illustrates a perspective view of an embodiment of a sensing pin S. As shown in FIG. 6, the sensing pin includes a central post 29 that may be made of non-conducting material, for example plastic, or conducting material, for example metal, depending upon the desired electrical operation of the contour sensor. For the purpose of this discussion, it should be assumed that the post 29 is made of a relatively rigid and non-conductive material such as plastic. It is preferred that the tip 31 of the sensing pin is rounded to avoid scraping the bottom of the foot or any other object that is pressed down to activate the pin. An electrically conducting contactor disk 33 is either formed with the post 29, for example by molding, or it is adhered to the post, for example by an adhesive.

In one experimental embodiment, the post 29 was about 3 inches (7.62 cm) long with about 1.4 inch (3.456 cm) extending below the disk 33 in order to engage the spring 25. The disk 33 was about 0.5 inches (1.27 cm) in diameter and about 0.045 inches (0.114 cm) thick. When pins with these dimensions are engaged in the housing 19 as shown in FIG. 5, about 1 inch (2.54 cm) of the top portion of the pins extends above the surface 15. The pins could be dimensioned so that they extend any desired distance above the surface 15 without departing from the invention.

The metal contactor disk is used to make and break a conductive connection between associated electrically conducting contacts 35*a* and 35*b* that are also made of metal. With reference to FIG. 5, the contacts 35*a* and *b* are disposed on the surface of a printed circuit board 37 that is adhered or otherwise affixed, for example by screws, to the underside of the support 15.

With reference to FIGS. 5 and 6, the contactor disks 33 of sensing pins S are therefore held by their respective springs 25 in conductive contact with their associated contacts 35*a* and *b* disposed on the printed circuit board 37. When the sensing pins S are at the rest position shown in FIG. 5, all pins provide conductive contact between their associated switch contacts 35*a* and *b*. Shortly after a pin touches the underside of the foot, it is pressed downward and the metal contactor disk 33 is moved away from the contacts 35*a* and *b* which therefore define an open circuit.

Figures 7, 8, 9:
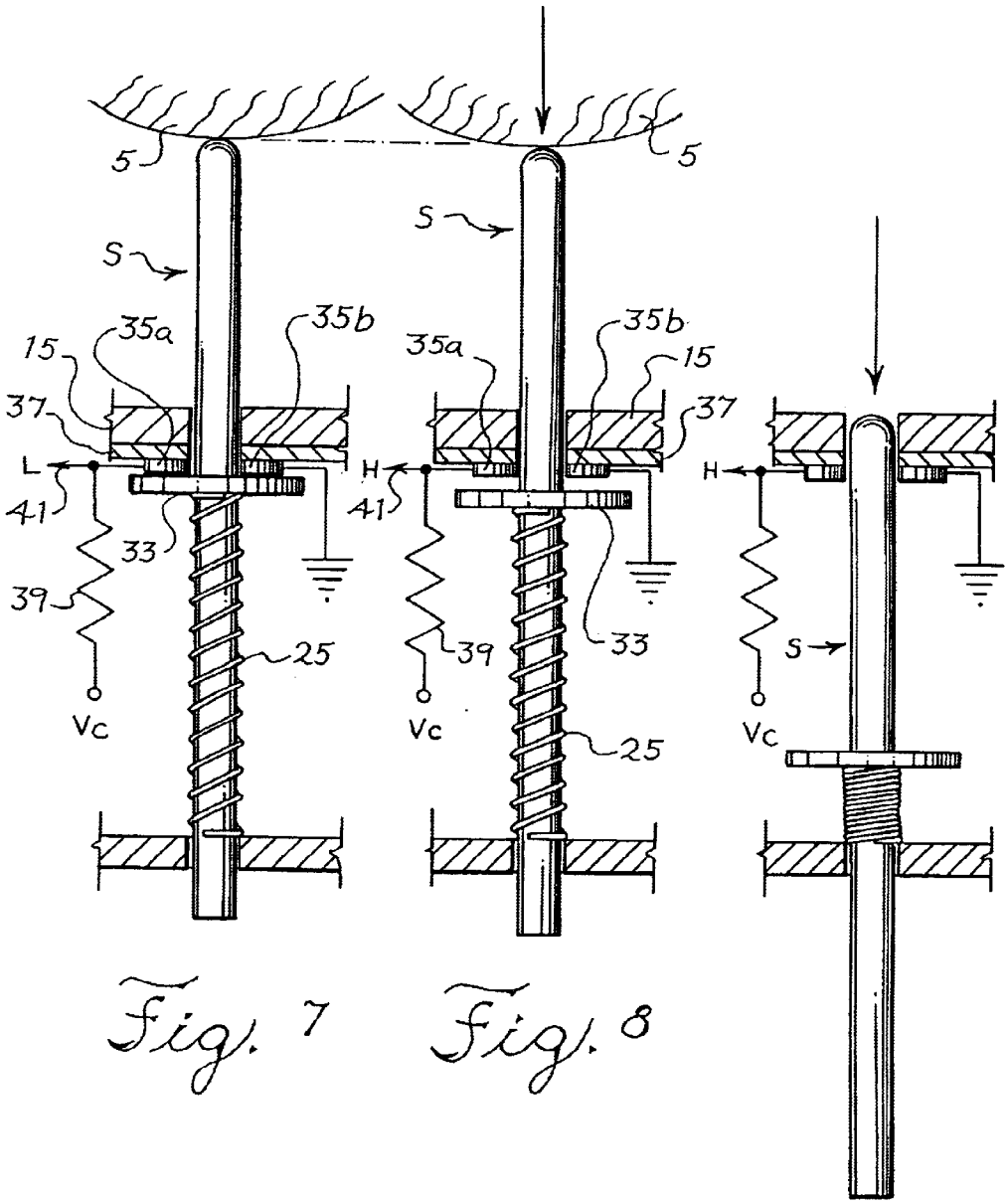
FIG. 7 is a partial cross-sectional side view of a first embodiment of a sensing pin in its fully extended rest position just prior to engaging the foot.
FIG. 8 is a partial cross-sectional side view of the sensing pin of FIG. 7 after it initially engages the foot.
FIG. 9 is a partial cross-sectional side view of the sensing pin of FIGS. 7 and 8 in a fully displaced position.

FIG. 7 illustrates a partial cross-sectional view of a sensing pin S in association with the contacts 35*a* and *b* that are supported on the printed circuit board 37. The contacts 35*a* and *b* may be formed on the printed circuit board 37 in a conventional manner as conducting pads or traces or as separate contactor elements. In FIG. 7, the thickness of the contacts 35*a* and *b* and contactor disk 33 are emphasized to facilitate an understanding of the invention. In practice, the contacts 35*a* and *b* may be made of thin metal foil or may be made considerably thicker in order to enhance the reliability and life of the conductive connection with the disk 33. The diameter of the disk 33 may be considerably less than 0.5 inches (1.27 cm) and the corresponding dimensions of the contacts 35*a, b* may be reduced in order to allow relatively close placement of the pins in an array.

FIG. 7 shows the sensing pin S in its upwardly biased rest position just before contact with the underside of a foot 5. In this position, the metal contactor disk 33 closes the electrical circuit between the contacts 35*a* and *b*. This electrical connection operates with a voltage Vc that is applied to a resistor 39 connected to the contact 35*a*. The contact 35*b* is connected to ground. The output of the switch formed by the sensing pin S is shown by the "L" symbol at 41. In operation, the conductive contact between the elements 35*a* and *b* connects ground to the side of the resistor opposite the voltage input Vc. This causes a low logic level to be applied at the output 41 of the sensing pin S. In the discussion hereinafter, it is assumed that the voltage Vc is regulated at about 5 volts, which is sufficient to power electrical components of the type that will be discussed hereinafter.

FIG. 8 illustrates the sensing pin S immediately after it has contacted the surface of the foot 5. After the initial contact with the foot, the pin is moved downwardly slightly until the contactor disk 33 is disconnected from the contact elements 35*a* and *b*. The breaking of the electrical circuit between these contacts indicates that the end of the pin S has touched the undersurface of the foot 5. In this "pin actuated" state, the ground applied at the contact 35*b* is removed from the end of the resistor 39 opposite the voltage Vc and the output 41 of the circuit therefore rises to a high voltage that is an H (high) logic level.

As shown in FIG. 9, as the pin S continues to be pressed downward, it may eventually reach the illustrated fully pressed position. The movement of the pin past its initial actuation position to the fully pressed position does not alter the high logic output of the switch associated with the pin. The sensing pin S therefore maintains a low logic level for as long as it is in its rest position and generates a high logic level after it has contacted an object, for example the foot.

The electrical signal at the output of the sensing pin S therefore provides useful information at the transition of the output logic signal from a low to a high. This transition in the electrical signal indicates that the pin has contacted a surface. Although the signal is not generated until the pin has moved minutely from its initial fully extended position, as a practical matter this small movement of the pin is insignificant in relation to the dimensions of the contour that is being measured. Also, since all pins must move this small distance, the slight movement acts only as a small and insignificant offset to the relative pin positions of the contour sensor.

Figure 10:
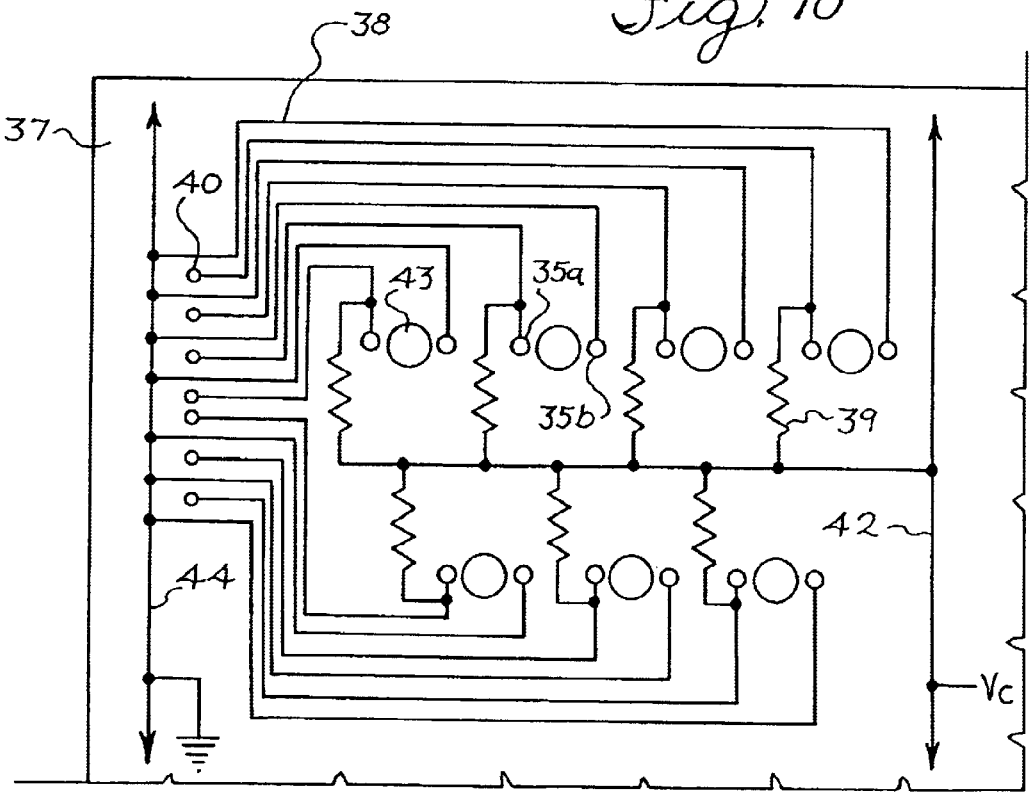
FIG. 10 is a partial plan view of a printed circuit board that is used to detect the initial movement of the sensing pins.

FIG. 10 illustrates a partial plan view of the printed circuit board 37 that is disposed under the support surface 15. As shown in FIG. 10, the printed circuit board has holes 43 that align with holes in the surface 15 and the holes 9 of the plate 7. The holes 43 pass the top portion of the sensing pins S. These holes may be dimensioned slightly larger in diameter than the pins in order to provide reasonable clearance for smooth axial movement of the pins. The contacts 35*a* and 35*b* are disposed on opposite sides of the holes 43 and are connected by conducting metal traces 38 to resistors 39, output pins 40, and power and ground buses 42 and 44. The traces and all components may be disposed on one side of the printed circuit board or the traces may be separately disposed on the side of the printed circuit board that abuts the underside of the supporting surface 15 and connects through holes with the pins and resistors in a conventional manner.

Although the contacts 35*a*, 35*b* are shown as flat circles, it should be understood that they could be any appropriate shape. For example, these elements could be rectangular, square, C-shaped or have cantilevers or other types of spring contacts in order to provide good conductive contact with the associated metal contactor disk 33 (shown in FIG. 6). Also, although the contactor 33 is shown in FIG. 6 as a flat metal disk, it should be understood that other shapes and contactor designs, for example employing spring contacts, could be used without departing from the invention.

The printed circuit board 37 of FIG. 10 includes pull-up resistors 39 and connections to power and ground discussed with respect to FIGS. 7–9. The resistors 39 are disposed in positions that do not interfere with movement of the sensing pins S. These resistors may be in any form or made of any known resistance material that is suitable for this type of application. In general, high precision components are not required, because they function only as pull-up resistors. Pull-up resistors rather than pull-down resistors are preferred, because they provide a greater tolerance for a high logic signal. However, pull down resistors and reverse polarity electrical signals could be employed without departing from the invention.

Figure 11:
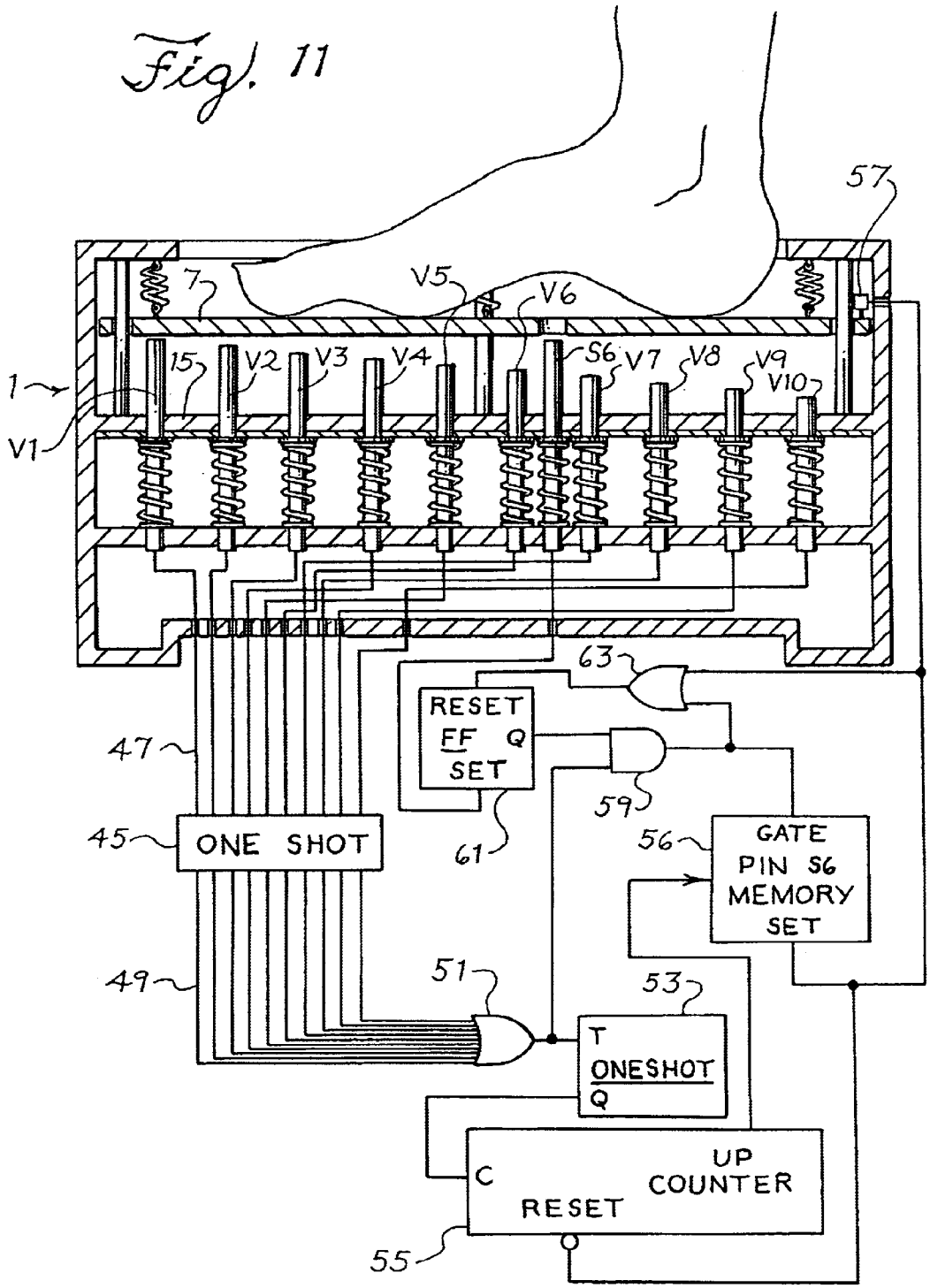
FIG. 11 is a partial cross-sectional view corresponding to the apparatus of FIG. 5 shown with a logic diagram of a control circuit.

FIG. 11 illustrates a partial cross-sectional view of the contour sensor 1 of FIG. 5 in association with a series of sensing pins V1–V10 that are used to measure the vertical displacement of the plate 7 in relation to the surface 15. These vertical position pins do not pass through holes in the plate 7 and therefore, as illustrated in FIG. 11, there are no holes shown above these pins. For the purpose of this discussion, a single sensing pin S6 is shown to illustrate this difference between the vertical position pins and the sensing pins.

In operation, as the plate 7 is pressed down, it first contacts a pin V1 that is then pressed down slightly to generate a high logic signal in the manner previously described. The high logic signal of this pin V1 indicates that the plate 7 is disposed at its highest measured position with respect to the surface 15. In one embodiment of a control circuit, the signal from this vertical position pin V1 is applied to an input of a monostable multivibrator or one shot 45 on a line 47. The low-to-high transition of the electrical signal on the line 47 causes the one shot to generate on the line 49 a pulse having a predefined width sufficient to avoid switch bounce effects. The positive pulse on the line 49 is applied as an input to an OR gate 51.

The OR gate 51 passes the positive pulse from the one shot 45 to a delay one shot 53 that generates a pulse which is triggered on the trailing edge of the input pulse. The delayed positive pulse at the noninverting output of the one shot 53 is applied to increment a counter 55. This counter was previously reset to zero by an initial condition switch 57 that is actuated when the plate 7 is at its top rest position. The counter is therefore incremented to a count of 1. The initial condition switch 57 also sets a pin S6 memory 56 to its highest variable which is 11. As previously discussed, this memory is used only to record the relative position of the sensing pin S6 of FIG. 11 when it contacts the underside of the foot.

Before the pulse triggered by the vertical position pin V1 increments the counter 55, it is applied to an input of an AND gate 59. This gate 59 does not pass the pulse to trigger the pin S6 memory, because the other input to the AND gate disables the gate with a low signal generated from the output of a flipflop 61. The output of the flipflop is low, because the initial condition switch 57 initially generated a low logic signal that was passed through an OR gate 63 to reset the flipflop 61 and therefore disable the AND gate 59.

As the plate 7 is pressed down, other vertical position pins V2–V10 are successively actuated to indicate the relative vertical position of the plate as it descends toward the surface 15. As shown in FIG. 11, the top portion of each successive vertical position pin is slightly shorter than the top portion of the preceding pin. In the embodiment of FIG. 11, the height of the top portion of the longest pin V1 is 1 inch (2.54 cm) above the surface 15 and each successive pin decreases by about 0.1 inch (0.254 cm). Other vertical dimensions, numbers of vertical position pins and decremental dimensions for successive pins could be employed without departing from the invention.

The vertical position pins V1–V10 are shown in line in FIG. 11 in order to simplify the drawing. In practice, the pins can be located wherever they can contact the underside of the plate 7. As an example, FIG. 4 shows the pins V1–V10 located around the periphery of the plate 7. The pins do not have to be arranged in any particular order because they operate independently to indicate the vertical spacing of the plate 7 and surface 15.

As each of the vertical position pins V1–V9 is actuated, the one shot 45 generates a positive pulse that is passed by the OR gate 51 and blocked at the AND gate 59. The delayed pulse for each actuated vertical position pin successively increments the count of the counter 55. Finally, the pin S6 of FIG. 11 passes through its hole in the plate and contacts the undersurface of the arch of the foot 5.

When the pin S6 contacts the foot, it generates an actuation signal as previously described which sets the flipflop 61. The noninverting output of the flipflop 61 is therefore a logic high and the AND gate 59 is enabled. Thereafter, when the final vertical position pin V10 is actuated, the one shot 45 generates a positive pulse that is passed by the OR gate 51 and the enabled AND gate 59 to the gate input of the pin S6 memory. The contents of the counter 55 is gated into the memory 56. The memory for the S6 sensing pin therefore contains a count which corresponds to the vertical position at which the pin V9 was actuated just prior to actuation of the vertical pin V10. The contents of the pin S6 memory therefore indicates the relative distance the plate 7 traveled prior to actuation of the V10 pin. The pulse at the output of the AND gate 59 is also applied by the OR gate 63 to reset the flipflop 61 and therefore disable the pin S6 circuit until the next sensing cycle is started by the initial condition switch 57.

After the count data is gated into the memory, the delayed signal from actuation of the V10 vertical position pin increments the counter 55. Thereafter, if any other pins of the contour sensor contact higher areas of the foot, the pin memory associated with any such pins will receive the "10" count of the counter 55 which was implemented by the actuation signal of the pin V10.

The logic circuit and block diagram of FIG. 11 illustrates a simple system that stores vertical count values at memory locations associated with each sensing pin of the contour sensor. All that is required is to utilize a relatively small number of some of the sensing pins to indicate incremental changes in the vertical position of the plate 7. It should be understood that, although sensing pins are used for this purpose, other mechanisms could be used to sense or measure the relative movement of the plate 7 as it descends toward the surface 15. Thus, for example, a light emitting diode could be used in association with a reflecting gauge to generate successive position signals as the plate 7 moves downward. Continuous position sensors, for example potentiometers, could be employed to generate an analog signal representative of the relative movement of the plate 7. Such analog signals could be sampled and converted to digital count states or the analog values could be digitized and gated to pin memories. In any event, the apparatus stores relative distance measurements generated by movement of the plate 7 in pin memories for sensing pins as they are actuated by contacting the underside of the foot.

Figure 12:
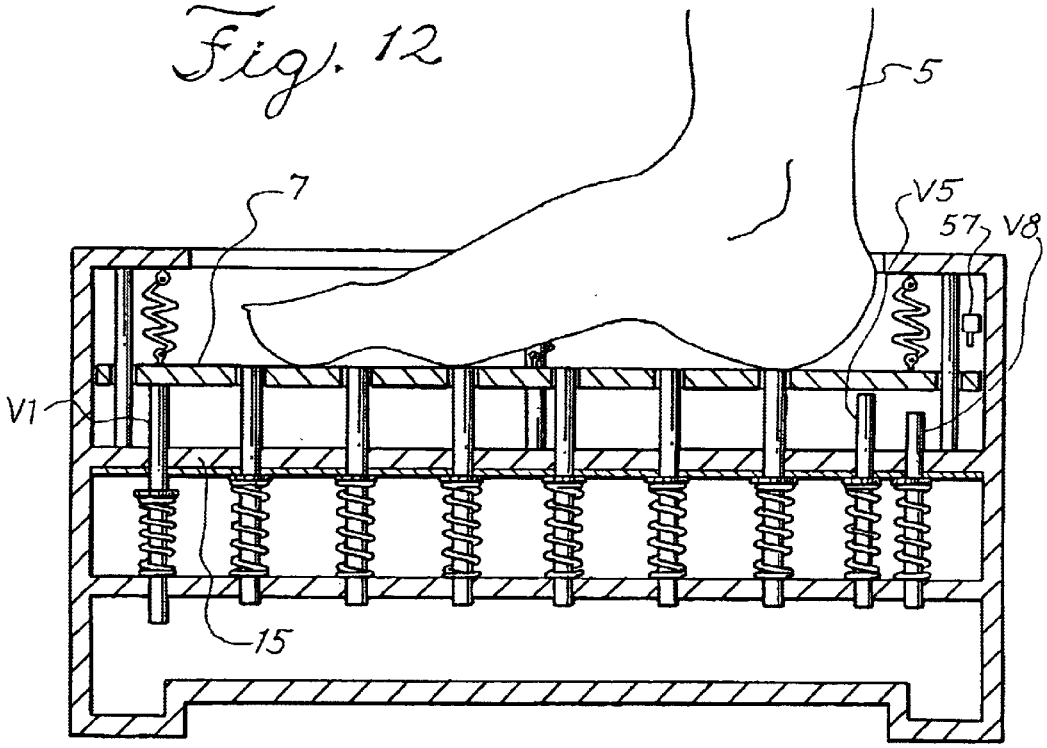
FIG. 12 is a partial cross-sectional view corresponding to the apparatus of FIG. 5 with the foot pressed closer to the underlying sensing pins.

FIG. 12 illustrates the contour sensor of FIGS. 5 and 11 with the plate 7 pressed further down by the foot 5. In the position shown in FIG. 12, the vertical position pin V1 has been actuated as the plate 7 moves downward. In the indicated position, none of the illustrated sensing pins have generated actuation signals in response to contacting the foot. Also, additional vertical position pins V5 and V8 have not been actuated.

Figure 13:
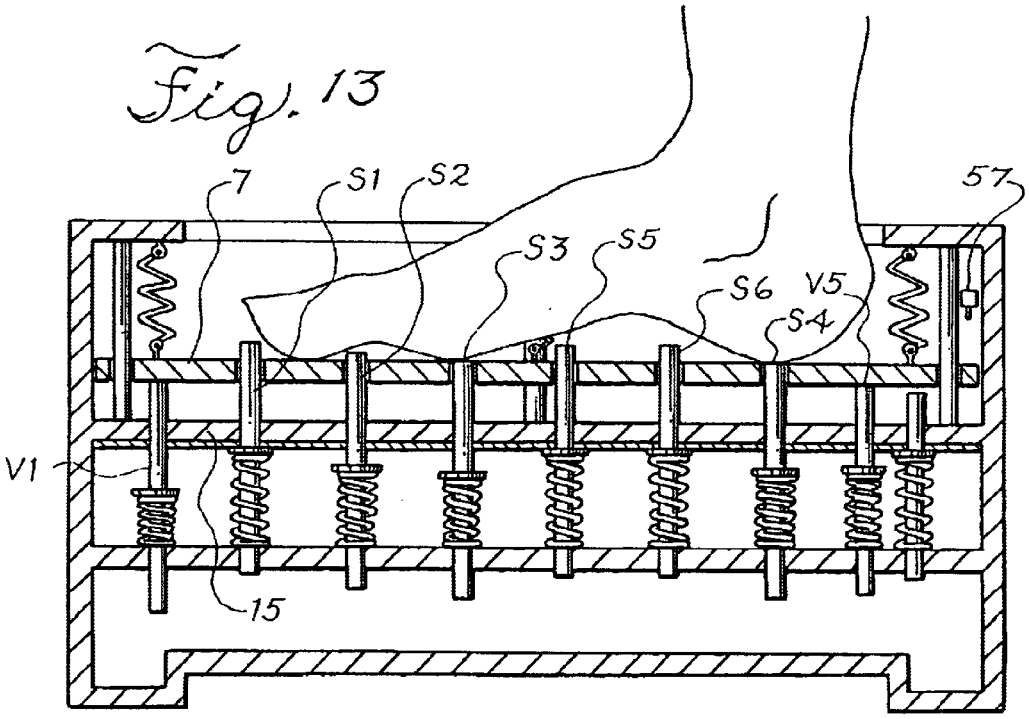
FIG. 13 is a partial cross-sectional view corresponding to the apparatus of FIG. 12 with the foot pressed closer to the underlying sensing pins.

FIG. 13 illustrates the apparatus of FIG. 12, with the plate 7 pushed closer to the surface 15. In this position, the sensing pins S2, S3, and S4 have been actuated and their associated memory locations have received counts corresponding to the vertical position of the plate 7 at the time that they were actuated. The vertical position pin V5 has also been actuated and has set the count state of the counter as discussed with respect to FIG. 11.

The sensing pins S1, S5 and S6 are not actuated because they have not contacted the foot.

Figure 14:
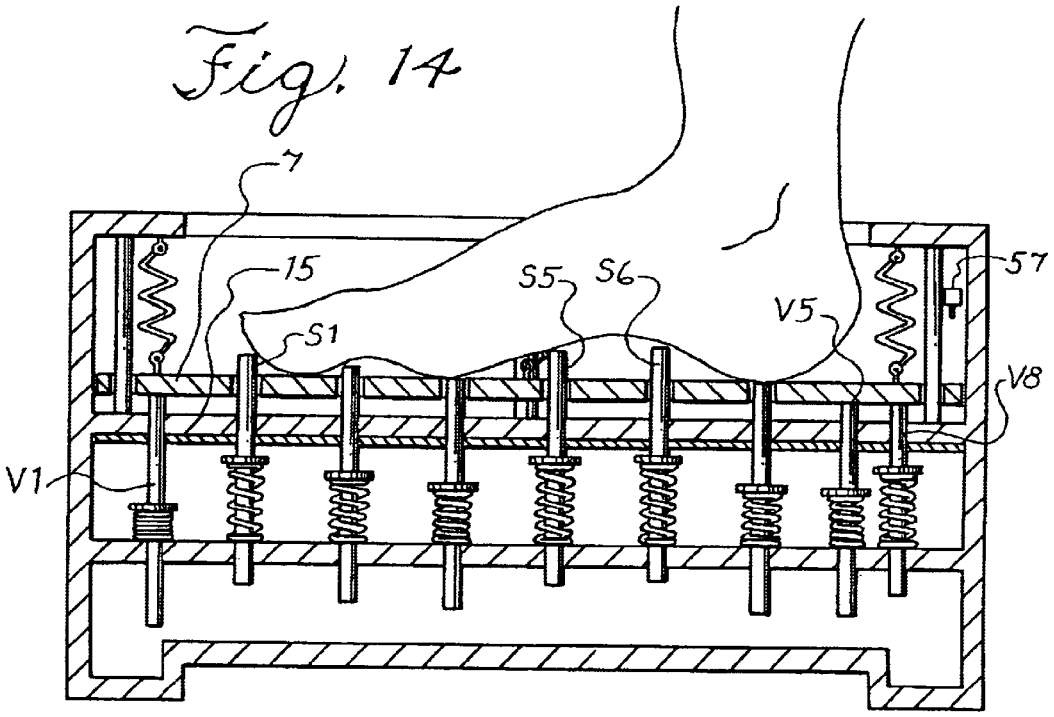
FIG. 14 is a partial cross-sectional view corresponding to the apparatus of FIG. 13 with the foot pressed closer to the underlying sensing pins.

FIG. 14 illustrates the contour sensor when the plate 7 is pressed to its lowest position adjacent to the surface 15. In this position all vertical position pins, including pin V8, have been actuated and the remaining pins S5 and S6 have also been actuated and have caused their associated memory locations to receive the count state that occurred at the time they were actuated. It should now be understood that the contour sensor of the invention operates quickly with high speed digital circuitry and generates stored digitized information corresponding to the contour of the underside of the foot.

Figure 15:
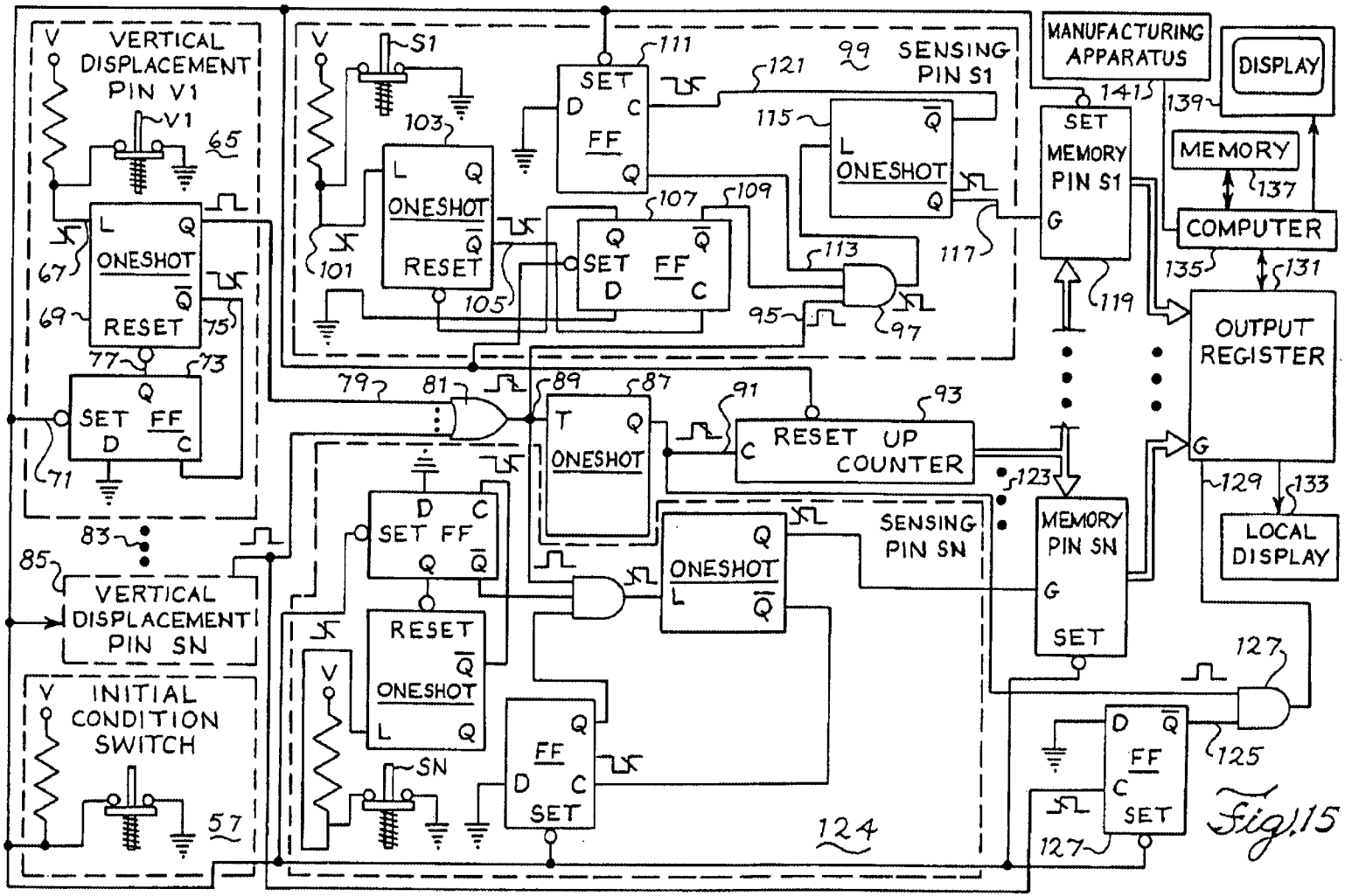
FIG. 15 is a logic circuit diagram of one embodiment of a control circuit of the invention.

FIG. 15 illustrates a circuit diagram of one control embodiment for the contour sensor that uses logic components. In operation of the circuit of FIG. 15, the vertical displacement pins sense the downward motion of the plate 7 in relation to the surface 15 in a manner previously discussed in summary with respect to FIG. 11. With reference to FIG. 15, logic components 65 for the first vertical displacement pin V1 are shown encircled by a dashed line. With reference to this portion of the logic circuit, the vertical position pin V1 operates as previously described to detect a particular decremental vertical distance between the plate 7 and the underlying surface 15,) as shown in FIG. 11. When the plate 7 contacts the pin V1, a logic signal that transitions from a low to a high is applied at an input 67 of a one shot 69. As explained previously, the one shot 69 generates an output pulse having a predefined duration in response to a "leading edge" logic transition from low to high at the L input 67. The input 67 is identified as L to indicate that the one shot is triggered on the low to high transition of the leading edge of the input pulse.

Before discussing further the operation of the vertical displacement portion of the circuit, it should be understood that the circuit of FIG. 15 is set to its initial conditions by the initial condition switch 57 that was previously described with respect to FIG. 11. This switch is actuated when the plate 7 is at its topmost position. In this position the switch is pressed and, as shown in FIG. 15, a low logic level is applied to a set input 71 of a D flipflop 73 of the vertical displacement circuitry 65. The logic low set signal causes a logic high to be generated at the noninverting Q output 77 of the flipflop 73. This is therefore an initial condition for the vertical displacement circuit 65. It should be understood that the low logic level of the initial condition switch 57 is also applied to other portions of the logic circuit 15 in order to define initial conditions for various logic components of the circuit.

With reference to the vertical displacement portion 65 of the circuit, the inverting output 75 of the one shot 69 generates a negative logic pulse in response to the leading edge transition at the input 67. This negative pulse is applied to the clock input of the D flipflop 73. This flipflop operates in a known manner in response to the positive transition at the trailing edge of the clock signal to generate a low logic signal at the noninverting output 77 of the flipflop 73. This constant logic low signal holds the one shot 69 in a reset state so that it does not respond to any further signals from the vertical displacement pin V1. The one shot 69 therefore generates a single pulse in response to actuation of the vertical displacement pin V1. The one shot remains disabled until the foot is removed, the plate 7 returns to its rest position and the initial condition switch 57 again sets the flipflop 73.

The positive pulse output of the one shot 69 of the vertical displacement circuit 65 is applied to one input 79 of an OR gate 81. The OR gate operates in a known manner to pass a positive pulse from any of its inputs, if the other inputs are low. The inputs of the OR gate 81 are connected to logic circuits for all of the vertical displacement pins V1–V10 that are shown in FIG. 11.

Each vertical displacement pin has its own associated logic circuit corresponding to the logic circuit 65. With reference to FIG. 15, the details of the logic circuit 65 for the vertical displacement pin V1 are shown and the corresponding logic circuit portions for the remaining vertical displacement pins are not individually illustrated in order to simplify the diagram of FIG. 15. Additional vertical displacement pin circuits are referenced by the ellipsis 83, and the last vertical displacement pin circuit is shown by the dashed box 85.

In operation of the circuit of FIG. 15, any one of the vertical displacement pins V1–V10 will cause a positive pulse to be generated at the output of the OR gate 81 when the pin is actuated. As previously discussed, each vertical displacement pin can generate only one positive pulse at the output of the OR gate 81 for each operational cycle defined by the initial condition switch 57.

With reference to FIG. 15, the positive pulse at the output of the OR gate 81 is applied to a trailing edge triggered one shot 87 that generates a pulse of a predetermined width in response to the trailing edge of the input pulse. The operation of this one shot is indicated by the T at its input 89. The T indicates that the one shot is triggered by the trailing edge of the input pulse.

The noninverting output 91 of the one shot 87 applies a positive pulse to the clock input of an up counter 93. This counter increments its count in response to the trailing edge of the input clock pulse at 91. The initial condition switch 57 resets the counter to zero as an initial condition. Thereafter, each clock pulse at the input 91 increments the counter by one. The first pulse associated with actuation of the V1 position pin will therefore increment the counter to 1.

It should be appreciated that the trailing edge activated one shot 87 and the trailing edge activated counter 93 provide a delay with respect to the initial triggering pulse from the OR gate 81. As shown in FIG. 15, prior to this delay, the positive pulse of the OR gate 81 is applied to an input 95 of an AND gate 97. The AND gate 97 will pass the positive pulse at its input 95 if its other two inputs are each a logic high.

A circuit 99 that contains the AND gate 97 is encircled with a dashed line and its provided to respond to the first sensing pin S1 of the array of sensing pins. This pin S1 was referenced in the general discussion with respect to FIG. 13.

As shown in the circuit 99, the sensing pin S1 generates a logic signal that transitions from low to high in response to actuation of the pin when it presses against the foot. This leading edge transition of the signal from the pin S1 is applied at an input 101 of a leading edge triggered one shot 103. The one shot 103 generates a negative pulse at its inverting output 105 and this pulse is applied to the clock input of an associated flipflop 107 that was previously set by the initial condition switch 57. The initial setting of the flipflop 107 caused a low blocking logic level to be applied to the AND gate 97 from the inverting output 109 of the flipflop. Another flipflop 111 is set by the initial condition switch 57 and therefore enables the other input 113 of the AND gate 97. The AND gate 97 will therefore not pass a vertical displacement pulse from the OR gate 81 until the associated sensing pin S1 triggers the one shot 103 and causes the flipflop 107 to enable the input 109 of the AND gate.

When the AND gate is enabled by actuation of the sensing pin S1, the next positive pulse resulting from actuation of a vertical displacement pin causes the AND gate 97 to pass a positive pulse to a leading edge triggered one shot 115. The one shot 115 then generates a positive pulse at a gate input 117 of a 4-bit memory circuit 119 or memory address that is associated with the sensing pin S1. This 4-bit memory was previously set to its maximum value of "1111" by the initial condition switch 57.

When the gate 117 of the memory circuit or address 119 is activated by the positive pulse from the one shot 115, the contents of the counter 93 is gated into the memory to overwrite the set contents of the memory. In operation of the circuit of FIG. 15, the counter 93 has a count state that is defined by the number of delayed vertical displacement pulses that it receives at its clock input 91. The state of this counter is gated into the memory 119 after the sensing pin circuit 99 is actuated by the switch S1 and by a vertical displacement pulse of the OR gate 81. For timing reasons, the vertical displacement pulse from the OR gate 81 causes the contents of the counter 93 to be gated into the memory 119 before the count state of the counter is incremented by the delayed pulse from the one shot 87. The memory 119 therefore contains the count state of the counter 93 which was set by the vertical displacement pulse of the OR gate 81 that occurred prior to the vertical displacement pulse that activated the sensing pin S1 logic 99. This operation ensures that a stable count at the output of the counter 93 is applied to the input of memory, for example the memory 119, when the memory is gated.

At the time that the memory. 119 is gated, the one shot 115 generates a negative pulse at its inverting output 121 and clocks a low-logic level to the noninverting output 113 of the flipflop 111 on the trailing edge of the negative pulse applied at 121. The input 113 of the AND gate 97 is therefore disabled after count data is written to the memory 119. Thereafter the circuit 99 for the sensing pin S1 cannot be activated until the plate 7 returns to its up position and the initial condition switch 57 again sets and resets the logic circuitry as previously described. The circuit 99 for the sensing pin S1 therefore generates a single pulse to gate its associated memory 119 after the pin S1 is actuated and at the time that a vertical displacement pulse is applied from the OR gate 81. The other sensing pins of the contour sensor operate in the same manner to gate the count state of the counter 93 to their memories when they are actuated and the next vertical displacement pulse is received.

The circuitry for each sensing pin corresponds exactly to what has been disclosed for sensing pin 1. In order to simplify FIG. 15, the circuitry for remaining pins is represented by an ellipsis 123. The circuit of FIG. 15 also shows the circuitry at 124 for the last sensing pin SN of the contour sensor. The circuit for this pin operates in exactly the same manner as was described for the circuit 99 for sensing pin S1.

In operation of the circuit of FIG. 15, the vertical displacement circuits and sensing pin circuits generate signals as described which gate into pin memories 4-bit counts of the counter 93 that correspond to the points of actuation of the sensing pins. The memories for all of the actuated sensing pins therefore contain counts that indicate the vertical position of the plate 7 in relation to the underlying surface 15 at the time that the pin was actuated. The memory locations for any sensing pins that are not actuated will contain a predefined maximum count state to indicate that the pin was not actuated. This count state was set at the beginning of the cycle as previously discussed with respect to the operation of the initial condition switch 57.

When the last vertical displacement circuit 85 is actuated, all available data has been stored in memory and the positive pulse actuation signal for this last vertical displacement pin is applied to gate a positive enabling signal on a line 125 at the inverting output of a flipflop 127. This flipflop was previously set by the initial condition switch 57 to provide a nonenabling low signal on the line 125. A corresponding AND gate 127 is therefore initially disabled by the initial condition switch and is enabled by the actuation of the last vertical displacement pin.

The AND gate 127 is therefore enabled just prior to the time at which the last vertical displacement pin V10 could cause data to be read into memory. If data is gated at this time, the associated delayed pulse at the output 91 of the one shot 87 is applied at the associated input of the AND gate 127. If the line 125 is enabled, this pulse is passed by the AND gate 127 to the gate input 129 of an output register 131. The gated output register 131 receives data from all of the memories for the sensing pins of the contour sensor. The output register 131 can then be used in a known manner to display the stored data on a local display 133, for example a CRT or liquid crystal display. As an example, the data could be displayed to show the detected contour of the foot and colors or numerical data could be used to show the measured displacement of the pins at various points on the foot.

The data from the output register could also be applied to a computer 135 which could then store the data in an associated memory 137, for example random access memory. The computer 135 could then analyze the stored array of data to determine the size and shape of the sensed foot. This analysis could be displayed on a visual display device 139, for example a CRT, liquid crystal display, plasma display or any other type of display used with computers. The computer 135 could also be programmed to analyze and apply the sensed data for the foot to select an appropriate shoe or shoe insert from inventory. The computer could also operate an associated manufacturing apparatus, for example a cutting, forming or milling device 141 which could make custom shoes or shoe inserts from the sensed data of the foot or from the sensed data of the left and right feet.

FIGS. 16 and 17 illustrate an alternative embodiment of a sensing pin for the contour sensor. FIG. 16 illustrates a partial cross-sectional view of a sensing pin that uses a foam cylinder 143 to bias the sensing pin upward. This cylinder has a central hole through which the base of the sensing pin extends. FIG. 17 illustrates the pin of FIG. 16 in a fully actuated position.

FIG. 18 illustrates another embodiment of a sensing pin 145 that has a top plastic shaft 147 and an associated lower body portion 149 that is also made of plastic. The parts for this sensing pin are available from the Hillman Fastener Company of Cincinnati, Ohio. The shaft 147 and bottom portion 149 are sold as separate parts and may be adhered together by use of a suitable plastic adhesive. A metal washer 151 is also adhered to an underlying conical plastic support 153.

The lower shaft 149 has a greater diameter than the upper shaft 147 and is dimensioned to receive the coil bias spring that was previously described. The thicker bottom shaft provides a stable support for the upper shaft 147. The bottom shaft also has threads or ribs 155 that provide a rough surface adjacent to the bottom end of the pin. This rough surface has the advantage of increasing the friction between the pin and its associated support hole when the pin is initially actuated. A slight additional force is therefore required to initially actuate the pin and, after initial actuation, the smooth surface of the bottom shaft 149 reduces the force required to continue the pin moving in a downward direction.

The distal end of the shaft 149 also has a slot 157 that allows the end portion of the shaft to be separated, for example by inserting a nail or like element in the end of the shaft. The expansion at the end of the shaft could be used to temporarily hold sensing pins in position when the sensor housing is assembled. However, it would be preferred to utilize manufacturing equipment to automatically align the pins in the manufacturing process without requiring tools such as expanding elements.

FIG. 19 illustrates an alternative embodiment of a sensing pin that has a conducting metal shaft 157 in conductive contact with an associated conducting disc 159. In the fully extended position of the pin, the disc 159 conductively contacts a single contact 161 that is connected to a voltage Vc through a resistor 163. When the pin is not engaged with the foot, the output from the contact 161 is a logic high. As shown at the left of FIG. 19, when the pin makes initial contact with the underside of the foot, it presses against a conducting flexible fabric 165 that is grounded. The contact of the conducting pin 157 with the grounded flexible fabric 165 closes an electrical circuit and applies a logic low at the output contact 161. As shown at the right of FIG. 19, as the foot continues to press down on the pin, the disc 159 is separated from the contact 161 and a logic high is therefore applied at the output of the pin. The sensing pin of FIG. 19 therefore generates a logic low when it initially contacts the underside of the foot and the following change in the output to a logic high confirms that the pin has contacted the foot.

FIG. 20 illustrates a diagrammatic side view of a foot in association with the contour sensor 1 of the invention which is disposed above the foot 5 with its extended pins facing downward. The pins may be biased by springs or foam as previously discussed or, alternatively, the force of gravity will provide full extension of the pins without requiring any other biasing element.

When the downwardly facing sensor 1 is lowered, it senses the contour of the top of the foot, as shown at FIG. 21. The sensing of the contour is achieved in the manner previously described. The data concerning the top contour of the foot may be combined with the data obtained concerning the bottom contour of the foot in order to provide a more detailed database for the shape of the foot. This database could be used as previously described to select shoes or inserts from inventory or to manufacture shoes or inserts. The database could also be used to provide digital images of the foot, for example for medical applications.

Figure 22:
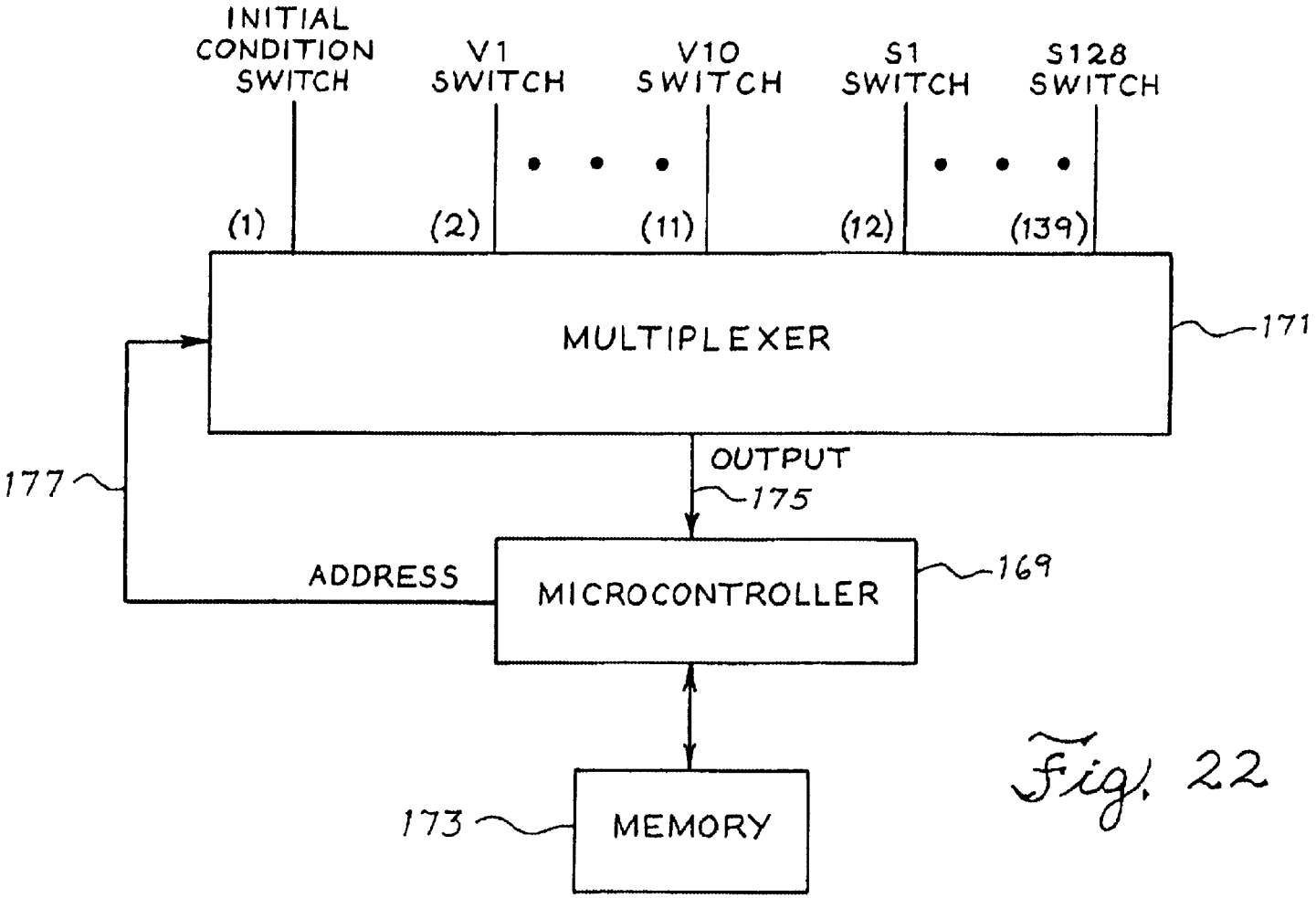
FIG. 22 is a block diagram of an alternative embodiment of a control circuit for a contour sensing apparatus of the invention.

FIG. 22 illustrates an alternative embodiment of a control circuit for a contour sensor having the previously-described features. This circuit employs a programmable microcontroller 169 that receives input signals from a multiplexer 171. As an example, suitable and relatively inexpensive microcontrollers can be obtained from: Microchip Technology, Inc. of Chandler, Ariz. (the PICMicro series); Intel Corp. of Santa Clara, Calif. (the 8051 series); Dallas Semiconductor of Dallas, Tex. (enhanced 8051 series); and Parallex, Inc. of Rocklin, Calif. (Basic Stamp II). The microcontroller is programmed to receive input signals and to manipulate and store corresponding variables in memory 173. The memory may be internal to the microcontroller and may include volatile random access memory for storing variables and nonvolatile EEPROM memory for storing a program. Some PICMicro microcontrollers, including the Basic Stamp II, are programmed in the PBASIC programming language. However, assembler language or other programming languages and other microcontrollers could be employed without departing from the spirit of the invention.

In the circuit diagram of FIG. 22, the multiplexer 171 is shown as a single box that has at least 139 inputs and a single output 175. In operation of such a multiplexer, the microcontroller 169 would apply an address at 177 which would access one of the input data lines and the low or high logic state of that line would then appear at the output 175. The microcontroller 169 can therefore individually read any of the 139 input data lines of the multiplexer 171 by applying the correct address at 177 and reading the output at 175.

In practice, it is not necessary to employ a single multiplexer having the indicated number of input leads. As an example, multiplexers are commercially available with 16 inputs, one output and four address lines. Nine multiplexers of this type could be employed to communicate with the microcontroller 169. In this case each multiplexer would apply its output data line as an input of the microcontroller. The output data line, with the proper address, would correspond to one of the 16 inputs of each multiplexer. All of the address lines of the multiplexers would be connected together and a corresponding 4-bit address would be provided by the microcontroller. In operation, the microcontroller would provide a 4-bit address that would access a particular defined bit for each of the nine multiplexers. The program would then read the corresponding nine data lines from the multiplexers and would provide the required programming operations for the input signals on these lines.

In order to facilitate an understanding of the invention, one multiplexer with 139 inputs has been illustrated. The operation of a system with such a multiplexer will be described hereinafter. It should be understood that any desired number of multiplexers having any desired number of input lines could be used in place of the single multiplexer with relatively simple modifications to the control program of the microcontroller 169.

The operation of the microcontroller will be described hereinafter with respect to a contour sensor that employs 10 vertical sensing pins and 128 contour sensing pins. It should be understood that the system of the invention is not limited to the number of pins that are used for illustrative purposes herein. Any desired number of vertical sensing pins and contour sensing pins can be used, without departing from the spirit of the invention. The invention is also not limited to a particular method for interfacing and mounting the microcontroller, multiplexer and memory with the sensing pins. For example, the microcontroller, multiplexer, memory and related components could be mounted on the circuit board that supports the sensing pins. Alternatively, the microcontroller, multiplexer and memory could be supported on a daughter board that uses cables to connect with the sensing pins of the main circuit board, for example at the output pins 40 of FIG. 10.

With reference to FIG. 22, the first input line of the multiplexer 171 receives the logic signal generated by the initial condition switch 57 of FIG. 11. As previously described, this switch generates a logic low when the support plate 7 is at its highest rest position. When a foot presses down on the plate 7, the switch 57 is released and a logic high signal is generated. For the following discussion, a logic low from the switch 57 is deemed a "foot removed" condition and the logic high of the switch indicates a "foot present" condition.

The second pin of the multiplexer 171 receives a logic signal from the first vertical position pin V1 of FIG. 11. The third input of the multiplexer receives a signal from the vertical position pin V2 and the following input lines of the multiplexer up to the 11th line respectively receive signals from the vertical position pins V3–V10.

The 12th input line of the multiplexer 171 receives a logic signal from the first sensing pin S1 that is illustrated, for example, at FIG. 13. The remaining input lines of the multiplexer receive logic signals from the remaining sensing pins of the array. The last input lead 139 for the multiplexer therefore receives a logic signal from the 128th sensing pin. As previously discussed, the vertical position pins V1–V10 and contour sensing pins S1–128 generate a low logic signal when the pin is at its rest position and a high logic signal when the pin is actuated as it is pressed by the foot.

Figure 23:
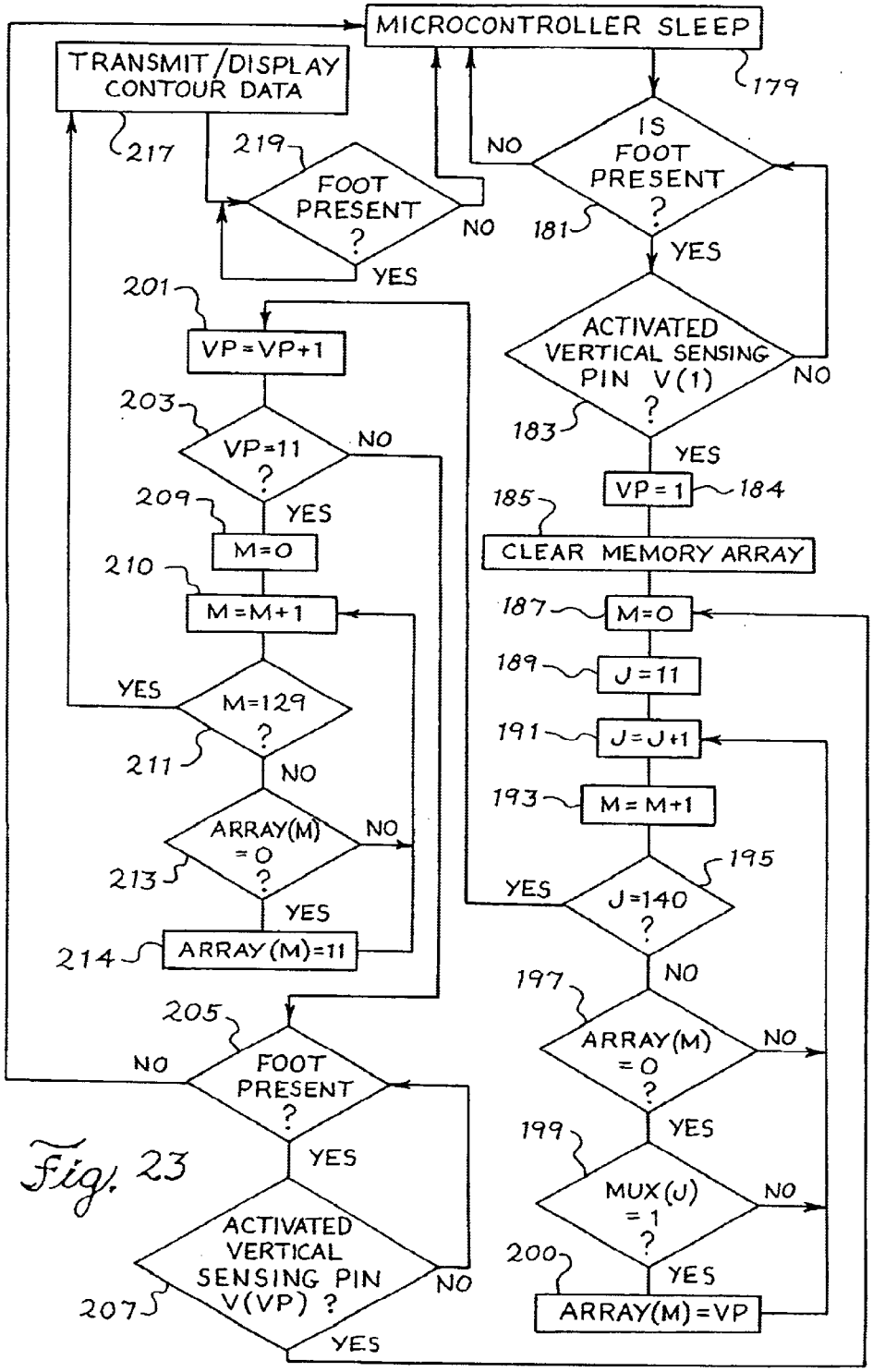
FIG. 23 is a flow chart of the software or firmware steps of an array sensing program for the microcontroller of the control circuit of FIG. 22.

FIG. 23 illustrates a block diagram of the program steps that are used to control the contour sensor described with respect to FIG. 22. With reference to FIG. 23, as indicated by the program block 179, the microcontroller 169 of FIG. 22 is operated in a low power sleep state when the plate 7 is at its top rest position, for example as shown in FIG. 11. In this rest state, the initial condition switch 57 generates a low logic signal. If a foot is placed on the plate 7 and begins to press the plate down, the switch 57 generates a high logic level which indicates that the contour sensor is in operation.

A decision element 181 of FIG. 23 tests the logic state of the initial condition switch 57. The microcontroller remains asleep for as long as a low logic signal indicates that the foot is removed from the plate 7. That is, the microcontroller remains asleep for as long as the signal at the first input of the multiplexer 171 remains at a logic low. When a foot is placed on the plate 7 and begins to press down, the initial condition switch generates a logic high and the decision block 181 therefore determines that the foot is present when it detects a corresponding high logic signal from the switch. The microcontroller is allowed to remain awake and a decision block 183 checks the logic state of the first vertical position sensing pin V1 that is applied at the second input of the multiplexer 171 of FIG. 22.

With reference to FIG. 23, if the V1 pin is not actuated, the program again checks the initial condition switch 57 and, if the foot has been removed, the microcontroller is returned to the sleep state. For as long as the foot is present, the decision block 183 will continue to test the logic state at the output of the first vertical sensing pin V1. When this pin is initially pressed and a resulting high logic signal is applied at the second input of the multiplexer 171, the decision block 183 causes a variable VP to be set to 1 at 184 and an array of locations in the memory 173 (FIG. 22) to be cleared at 185. The contents of the memory array will therefore be cleared for array positions from 1 to 128. Each position of the array is a 4-bit memory location that is provided to contain vertical displacement information for a corresponding sensing pin.

The clearing of the memory at 185 causes each 4-bit position of the array to store a zero value. Thereafter program counters are set at positions 187 and 189. The first program variable M is therefore set to a value of zero and the second program variable J is set to 11. The setting for the variable J is an offset that is used to access signals from the contour sensing pins S1–S128. Program blocks 191 and 193 thereafter increment the variables J and M and a decision block 195 determines if the variable J has exceeded its maximum valid multiplexer access count of 139.

If the variable J has not exceeded its acceptable maximum value, the contents of the first variable of the memory array is tested at 197. It is known that the memory has been cleared at step 185 and therefore the contents of the first variable of the memory array will be zero and program control will therefore be passed to the next decision block 199 which checks the logic state at the input of the multiplexer that corresponds to the first array position. This signal is located at the 12th input lead of the multiplexer which receives the logic signal from the first sensing switch S1. The S1 logic signal is therefore checked and, if it is high (i.e., if it is equal to 1) it has been actuated and therefore at point 200 the corresponding value of the memory array for S1 is set to the contents of the VP variable which was previously set to 1 at 184.

The value of 1 for Memory Array(1) indicates that this first sensing pin S1 was actuated either prior to or about the time that the first vertical sensing pin V1 was actuated. Thus, 1 is stored as the relative vertical position for the first sensing pin S1. If the sensing pin S1 had not been actuated, the decision block 199 would sense a low logic level on the corresponding 12th input of the multiplexer and would therefore not store a value in the memory array for S1. Program control would be returned to the point 191 and 193 at which the variables M and J are incremented.

It should be understood that the microcontroller 169 senses logic conditions of input signals of the multiplexer 171 that are applied on the line 175. Since these signals correspond to the electrical condition of switches, it is expected that, as a practical matter, the electrical signals will tend to "bounce" between logic states as the switch settles. The microcontroller 169 has predefined operations that can provide a delay to avoid transient logic readings at the time that a switch is initially selected. Such "debounce" operations are well known and are used to avoid detecting multiple signals for a single actuation of a switch. This is not a significant problem in the system of the invention because only the initial actuation of the sense switches and vertical portion switches are detected in a cycle. Multiple actuation of these switches caused by bouncing of switch contacts or slight up-and-down movements of the foot plate 7 will be ignored and will therefore not adversely affect the operation of the microcontroller. The initial condition switch 57 should preferably operate with a known hardware debounce circuit or a microcontroller implemented delay to compensate for bouncing contacts by generating or detecting a single logic signal in response to actuation of the switch.

With reference to FIG. 23, the next cycle of the program will check the memory array value that is stored for the second position of the array and will check the corresponding S2 signal input of the multiplexer to determine if the S2 sensing pin has been actuated. The program will cycle through this test for all 128 contour sensing pins. If any of these sensing pins have been actuated, their corresponding memory arrays will be set to 1 to indicate that they were actuated on or about the time that the vertical plate 7 had moved about 1 unit of vertical distance with respect to the underlying plate 15.

When all of the 128 sensing pins S1–S128 have been tested, the value of the variable J will be 140. The decision block 195 therefore transfers 5 program control and causes the variable VP at 201 to be incremented to its next value which is 2. The variable VP is then tested at 203 to determine if all of the vertical sensing pins have been actuated. A count of 11 for VP will indicate this condition because, in this embodiment, there are 10 vertical sensing pins. In this case the VP variable has been incremented to a value of 2 and program control will therefore be transferred from the decision block 203 to the following block 205 that checks if the foot is still present on the plate 7.

If the foot has been removed, the initial condition switch 57 will generate a low logic level and the decision block 205 will cause the microcontroller to go to sleep at 179. If the foot is still present and continues to press down on the plate 7, the decision block 207 checks to determine if the second vertical sensing pin V2 (i.e., for VP=2) has been actuated. If this vertical sensing pin has not been actuated, program control loops and continuously tests the condition of the second vertical sensing pin V2 and the foot present condition.

If the foot continues to press down on the plate 7, the second vertical sensing pin V2 will eventually be actuated and the multiplexer input line at VP+1 (i.e., the 3rd position in this case) will show a logic high. Program control will then be transferred to the point 187 at which the control variables M and J are set to their initial values. Thereafter, as previously described, the array of sensing pins is tested to determine if any have been actuated in association with the actuation of the second vertical sensing pin V2.

It should be understood that the program checks at 197 the value stored in the memory array for each sensing pin. If any sensing pin was previously actuated and a corresponding value was stored in memory for that pin, the program at 197 will not check the multiplexer input for that pin, but will move program control to increment the count values at 191 and 193 to check the array memory value for the next pin. That is, if a non-zero value is stored at the memory array location corresponding to a particular sensing pin, it is known that sensing pin has been previously actuated and there is therefore no reason to check the multiplexer input corresponding to that pin. This operation therefore ensures that only the vertical position of the initial actuation of each sensing pin is recorded. Thereafter the logic level input to the multiplexer for that sensing pin is ignored.

The program continues to operate as described in response to the presence of the foot and the logic signals provided by the vertical position pins V1–V10 and contour sensing pins S1–S128. The microcontroller senses, analyzes and stores data for the sensing pins so quickly that the memory array is filled with vertical position values for all actuated sensing pins in the short time that it takes a person to press his foot against the plate 7 and move the plate from its maximum up position to its down position. From the perspective of a human being, the operation of the microcontroller in obtaining and storing data appears to be, essentially, instantaneous.

When all vertical access pins have been actuated and vertical positions for all sensing pins have been stored, the decision block at 203 transfers program control to a software routine that stores a maximum vertical count value of 11 in all memory array locations that have a value of zero. The zero in these locations indicates that the associated sensing pins were not pressed by the foot and therefore remain in their upright, unactuated positions. Setting a maximum count for these pins indicates that the pins are fully extended and were not contacted by the foot. The maximum count of 11 that is set for these memory locations is outside the range of measured vertical positions for the contour sensor and therefore provides a unique value that indicates a sensing pin was not actuated.

With reference to FIG. 23, program control is transferred from the block 203 to set the counter M at 209 and 210 to a value of one. Thereafter a decision block 211 checks to see if the variable M exceeds its useful count value of 128. If this value is not exceeded, a decision block 213 checks to determine if the accessed value of the array is zero. If it is not zero, program control is returned to increment the counting variable at 210. If the array value is 0, its value is reset at 214 to the maximum value of 11 to indicate that the pin was not actuated. Program control is then returned to increment the counter M. The program continues until all zero values for unaccessed sensing pins have been set to 11. Thereafter, the decision block 211 passes control to a block 217 that causes the stored data to be transmitted to a computer, displayed, or otherwise used in a manner selected by an equipment operator.

For example, the stored relative counts could be converted to units of measurement with suitable scaling factors and simple calculations. These measurements could be used to determine the width, length and other physical characteristics of the foot. The data is used at 217 for any of the purposes that have been previously described or for any additional advantageous purposes. For example, the foot measurements of particular individuals could be recorded in a database with the types of shoes and sizes of shoes purchased by the individuals over time. The database could be used to correlate measured foot dimensions with associated shoe selections from different shoe manufacturers and personal preferences of the user, for example, a snug forefoot on certain types of shoes. A quantitative dimensional comparison, where one compares the physical dimensions of the foot, the physical dimensions of the previously selected footwear, and the physical dimensions of potentially selected footwear is particularly useful in view of the lack of industry standardization for the dimensionality of sizing, for example, the dimensions of a size 9½ D shoe in one style, may correspond closely with a size 10½ C in another. The database therefore allows quantitative correlations between foot dimensions and shoe size in a manner unique in this industry. The database could also be personalized to allow a retail store to keep track of the foot measurements and shoe purchases of customers in order to assist in fitting shoes over time and assist in selecting shoes as gifts for the customers in the database.

The plate 7 of the foot sensor could include a foot registration assembly with at least one guide member, for example a heel locator (not shown), to allow the foot to be centered within the array of pins. Although this apparatus might be of some help to the user, it will not be required if the microcontroller is programmed to determine the relative dimensions of the foot wherever it is placed in the array of pins. The user can therefore roughly center his foot within the area of the holes 9 of the plate 7 and the microcontroller can determine the dimensions of the foot from the resulting displaced pins without requiring precise alignment of the foot.

After executing the operations at step 217, program control is transferred to a decision block 219 at which the foot presence signal is checked. When the plate 7 is returned to its rest position, the initial condition switch 57 of FIG. 11 generates a logic low and the program responds to this condition by putting the microcontroller to sleep at 179. The microcontroller remains in this low power asleep state until a foot is again pressed against the plate 7 to initiate a new cycle for sensing the contour of a foot.

The embodiment described with respect to FIG. 23 may be implemented with low power CMOS components that can be powered with the microcontroller and memory by a DC battery. Alternatively, power may be supplied by a regulated voltage supply that is plugged into an AC power outlet. If battery power is used, a suitable low power liquid crystal display could be used as a data display.

The low power microcontroller can also be programmed to analyze the stored contour data in whatever manner is required to implement functions such as selecting or manufacturing shoes or shoe inserts. Alternatively, the microcontroller 169 can transmit the stored contour data, for example by means of a serial data link, to a more powerful computer that will analyze the data. Since the contour data is stored in a one dimensional array, the relative position of each data element of the array in relation to the foot can be determined by grouping the data in rows and columns corresponding to the arrangement of the sensing pins of the contour measurement apparatus. The physical position of each data element can then be determined by reference to its position in relation to a predefined X, Y coordinate axis for making the foot measurement. The data of the one dimensional array may be copied to a two dimensional array in order to facilitate this position analysis or, alternatively, the contour measuring system could collect the contour data in a two dimensional array.

Figure 24:
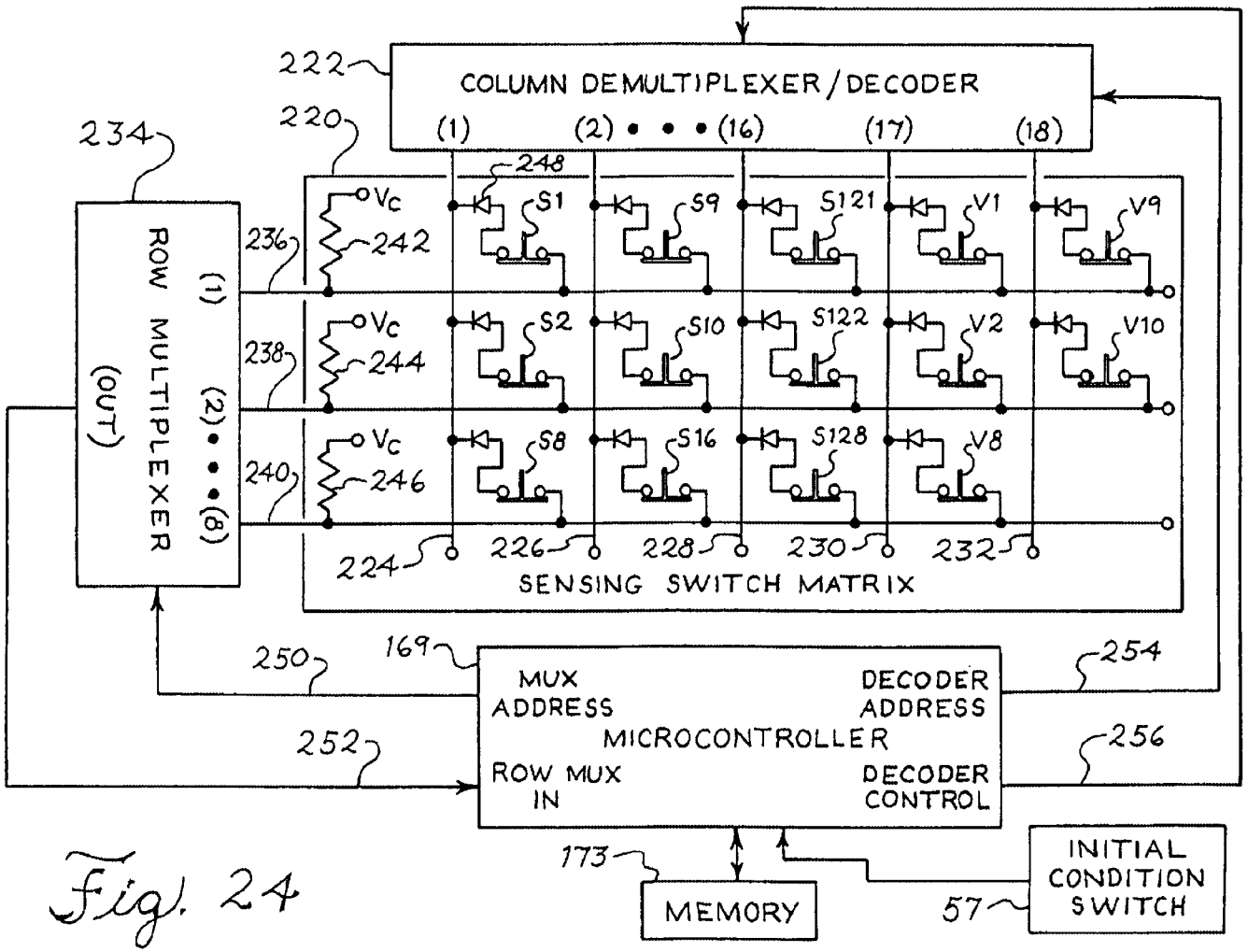
FIG. 24 is a block diagram of an alternative embodiment of a control circuit for a contour sensing apparatus of the invention.

FIG. 24 illustrates a block diagram of an alternative embodiment of a control circuit for a contour sensing apparatus of the invention. In this control circuit, the switches of the sensing pins S1–S128 and the switches of the vertical position pins V1–V10 are arranged in a matrix with electrically conducting column lines 224, 226, 228, 230 and 232 that intersect corresponding orthogonal electrically conducting row lines 236, 238 and 240. The column lines 224–232 and row lines 236–240 cross over one another as indicated but are not electrically connected at their crossover points. The column and row lines can be electrically connected only through the switches of the sensing pins S1–S128 and vertical position pins V1–V10. The column lines are electrically connected to a column demultiplexer/decoder 222 and the row lines are electrically connected to a row multiplexer 234. The demultiplexer/decoder and row multiplexer are electrically connected with the microcontroller 169 by lines 250, 252, 254 and 256.

The microcontroller 169 accesses a memory 173 that is typically located within the microcontroller. This memory could also be located outside the microcontroller without departing from the invention. The memory 173 has an internal random access portion that is used to store program variables and an EPROM or EEPROM portion that contains the program for the microcontroller. As previously discussed, this program can be provided in assembler language or in a high level programming language such as BASIC or PBASIC. The initial condition switch 57 which was previously discussed is also connected to the microcontroller 169.

In operation, the control circuit of FIG. 24 is used by the microcontroller 169 to sense the open or closed position of the switches of the sensing pins S1–S128 and vertical position pins V1–V10. With reference to FIG. 24, the column demultiplexer/decoder 222 has 18 output lines and the row multiplexer 234 has 8 input lines. Only a few of these lines are illustrated in FIG. 24 in order to simplify the drawing and facilitate an understanding of the invention. The illustrated lines will be referenced in the discussion hereinafter with the understanding that this discussion also applies to additional lines that are not shown in the drawing.

The row multiplexer lines 236, 238 and 240 are pulled up to a high voltage Vc through associated resistors 242, 244 and 246. If none of the switches in the matrix 220 are closed, the lines 236, 238 and 240 will remain at their high logic voltage levels. If any switches are closed, the row lines 236, 238 and 240 will also remain at their high logic voltage levels if high logic voltage levels are provided on the column lines for the closed switches. A low logic voltage level will be applied on a row line only if a switch on the row line is closed and the column line for that switch is held at a logic low voltage.

If, as an example, the switch of the sensing pin S1 (i.e., the S1 switch) is open, there is no conductive connection between the corresponding column line 224 and row line 236 connected to the switch. The row line 236 will therefore apply a high logic voltage level from the pull up resistor 242 to the corresponding input (1) of the row multiplexer 234. If the S1 switch is closed and the column line 224 is held at a logic high voltage, the voltage on the row line 236 will remain high because there is no significant voltage drop between the row line 236 and the column line 224. If the logic level of the column line 224 changes from a high to a low voltage and the S1 switch is open, the logic signal on the row line 236 will remain high because the column and row lines are disconnected by the open S1 switch.

If the S1 switch is closed and a logic low signal is applied on the column line 224, the low signal on the cathode side of an associated diode 248 and the positive voltage of the line 236 applied on the anode of the diode 248 cause the diode to conduct for as along as the S1 switch is closed. The closed S1 switch and conducting diode 248 therefore provide a path for an electrical current from the row line 236 to the associated connected column line 224 and the current is limited by the resistor 242. There is therefore a voltage drop across the resistor 242 so that a logic low signal is applied on the line 236 at the input (1) of the row multiplexer 234. The microprocessor 169 senses this low signal on the row line 236 and therefore determines that the S1 switch is closed. It should be understood that the switches of the sensing pins S2–S128 and vertical position pins V1–V10 operate in the same manner with respect to the associated row and column lines to which they are electrically connected.

The microcontroller reads the state of the switches of the matrix 220 by applying a logic low to only one of the column lines of the demultiplexer/decoder 222 at a time and then checking the logic signals of the row lines. Therefore, if a low logic signal is applied on the column line 224 as an example, high logic signals are applied on the remaining column lines and the row lines are checked. Row lines with low logic signals have a closed switch at the intersecting column (1) on the line 224.

When a high logic signal is applied on a column line, the logic signal on the row lines will not be affected by the open or closed condition of the switches in the logic high column. For example, if the S9 switch is closed, the high voltage on the cathode of its associated diode (from the logic high column line 226) and the high anode voltage on the associated row 236 will reverse bias the S9 diode and the diode will therefore not conduct. The reverse biased S9 diode provides an open circuit in series with the switch S9. There will therefore be no current through the closed switch S9 when its column line 226 is high. If the switch S9 is opened, the switch itself provides an open circuit and therefore does not affect any row line. The S9–128 and V1–V10 switches of the matrix do not affect the logic state of their associated row lines 236–240 for as long as the column lines 226–232 are held at a high voltage. Only the S1–S8 switches with the associated low signal on the column line 224 can affect the logic level of the row lines 236–240.

As a further example, if the S2 switch is closed and the column line 224 remains low, current will pass through the switch S2 and its associated conducting diode and a low logic signal will be applied at the corresponding row line 238. Likewise, if the switch S8 is closed, a low logic signal will be applied on the corresponding row line 240. If any of the S1–S8 switches are open while a low logic signal is applied on the column line 224, the corresponding row line will have a logic high signal because the open switch will disconnect the low column line from its associated row line. The row line will therefore be pulled up to the high voltage Vc logic level. The logic signals on the row lines therefore indicate the open or closed state of the corresponding switches that are connected to a logic low column line.

The diode 248 may be a standard silicon diode such as is commercially available with the designation 1N914. This type of diode has a forward bias voltage of about 0.7 volts. A voltage differential of about 0.7 volts between the anode and the cathode is therefore required before the diode begins to conduct. What this means in association with the control circuit of FIG. 24 is that, for example by reference to a closed S1 switch, the row voltage from the line 236 must be at least 0.7 volts higher than the associated cathode voltage on the column 224 in order to cause the diode 248 to conduct. This forward bias condition is easily achieved in the 5-volt operating system of the invention by applying a low logic signal from the demultiplexer/decoder at the cathode and an associated high voltage of about 5 volts at the anode. The diodes of a column are reverse biased and therefore define an open circuit when a high voltage is applied on the column. The reverse bias operation of the diodes prevents closed switches of logic high voltage columns from conducting and needlessly using power. The diodes therefore limit the power consumption of the matrix while it is being accessed and while it is in its inactive state. The diodes also ensure that multiple simultaneous closed switches do not overload the integrated circuit devices of the matrix. The diodes confine the maximum power drain to the 8 switches of the active column.

The matrix 220 could be operated with fewer diodes than shown in FIG. 24 if optimal power conservation is not required and if the integrated circuits are configured to handle the current conducted when all matrix switches are closed. Also, if the sense switches and vertical position switches are normally open, the matrix could be operated without diodes or with a reduced number of diodes because fewer simultaneous closed switches would be expected in normal operation of the contour sensing apparatus.

In operation of the circuit of FIG. 24, the condition of the switches is determined by serially applying a logic low voltage to one column line at a time. Thus, initially a logic low voltage is applied on the column line 224 when the microcontroller applies a corresponding address code on a decoder input line 254. The other column lines are held at logic highs. The microcontroller 169 then accesses the multiplexer 234 and reads the condition of the 8 row lines to determine the states of the switches in the activated switch column 224. The microcontroller reads the logic signals on the row lines by applying addresses to the multiplexer 234 on a line 250. Each row line 236, 238 and 240 has an associated address and the microcontroller can therefore determine the logic state of a particular row line by applying its address code at the input of the multiplexer 234 and reading the logic state on the output line 252.

After the microcontroller reads the condition of the switches in the S1 switch column, it applies the next successive decoder address on the line 254. This address causes a low signal to be applied on the next column line 226 and high signals to be applied on the other column lines. The microcontroller 169 then operates the multiplexer 234 as previously described and reads the logic signals on the 8 row lines that correspond to the states of the S9–S16 switches. The microcontroller 169 serially applies logic low signals on single column lines from column 1 to column 16 and reads the corresponding logic signals from the multiplexer 234 in order to determine the states of all of the sense switches S1–S128. The microcontroller 169 reads the switches for the vertical sensing pins V1–V10 in the same manner by successively applying low logic signals on the columns 230 and 232 and reading the corresponding logic signals detected by the row multiplexer 234. The microcontroller makes a record of the open or closed state of each of the S1–S128 sense switches and V1–V10 vertical position switches by recording corresponding variables in the random access memory portion of the internal memory 173.

The microcontroller 169 receives a signal from the initial condition switch 57 that indicates when the contour sensing apparatus of the invention is initially activated. This initial condition switch 57 operates in the manner previously described with respect to other embodiments of the invention. The microcontroller also applies a decoder control signal at 256 which sets the outputs of the demultiplexer/decoder 222 to logic highs when the state of the switch matrix 220 is not being sensed.

The column demultiplexer/decoder 222 of FIG. 24 is shown as a single device in order to simplify the drawing and facilitate an understanding of the invention. In practice, the 18 line demultiplexer/decoder may be made of at least two separate integrated circuit devices. Demultiplexer/decoder devices are commercially available in integrated circuit packages having 8 or 16 output lines. The column demultiplexer/decoder 222 of FIG. 24 could therefore be made of 2 units having 16 lines each, 3 units having 8 lines each or 1 each of the 16 line and 8 line units. These devices are all accessed by the microcontroller 169 by use of signals on decoder control lines corresponding to 256 and decoder address lines corresponding to 254. As an example, the decoder control line activates selected demultiplexer/decoder units and the same decoder address lines 254 access each of the selected decoders.

The row multiplexer 234 is commercially available with 8 input lines. If more rows of the array are required, a 16 input line multiplexer could be used or multiple 8 line or 16 line multiplexers could be employed and separately accessed, for example in the manner discussed with respect to the demultiplexer/decoder.

The control circuit of FIG. 24 has been described with respect to a sensing switch matrix that has 128 sensing switches and 10 vertical position switches. It should be understood that any number of sensing switches and vertical position switches can be employed and arranged in an array having any desired number of columns and rows, without departing from the invention. For example, additional demultiplexers/decoders could be added to add additional columns and additional multiplexers could be added to add additional rows. The disclosed matrix addressing system is well suited to adding additional sensing pins, because significant numbers of sensing pins can be added without requiring a great deal of additional apparatus and only minor changes are required in the program of the microcontroller 169 to accommodate additional sensing pins.

Figure 25:
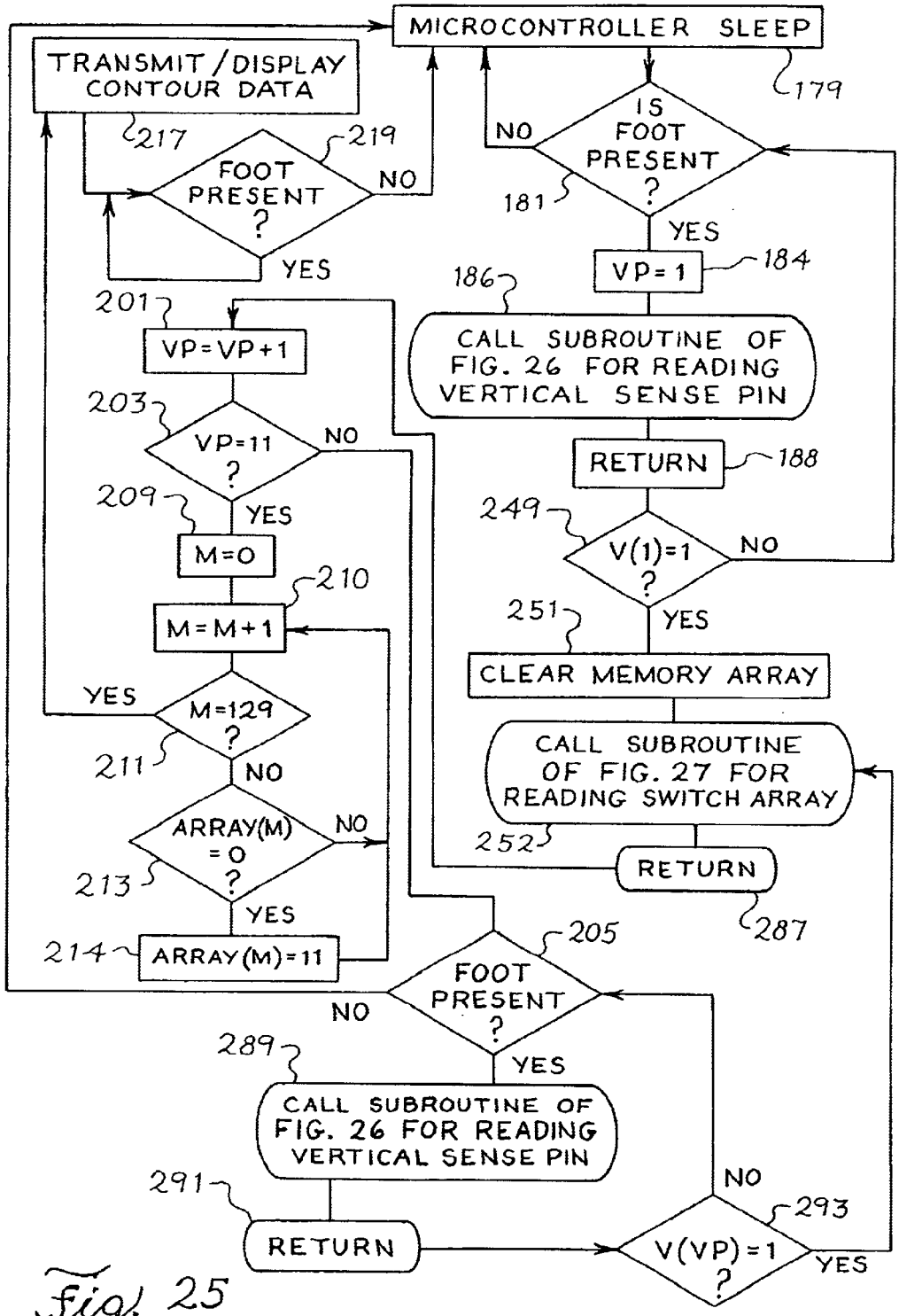
FIG. 25 is a flowchart of the software or firmware steps of an array sensing program for the microcontroller of the control circuit of FIG. 24.

FIG. 25 illustrates a flowchart of program steps for controlling the microcontroller 169 of FIG. 24. With reference to FIG. 25, if the foot is present at 181 as previously described, the microcontroller is awakened and a variable VP is set to 1 at 184. Thereafter, a subroutine of FIG. 26 is called at 186 of FIG. 25 in order to read the state of the vertical position pins V1–V10.

Figure 26:
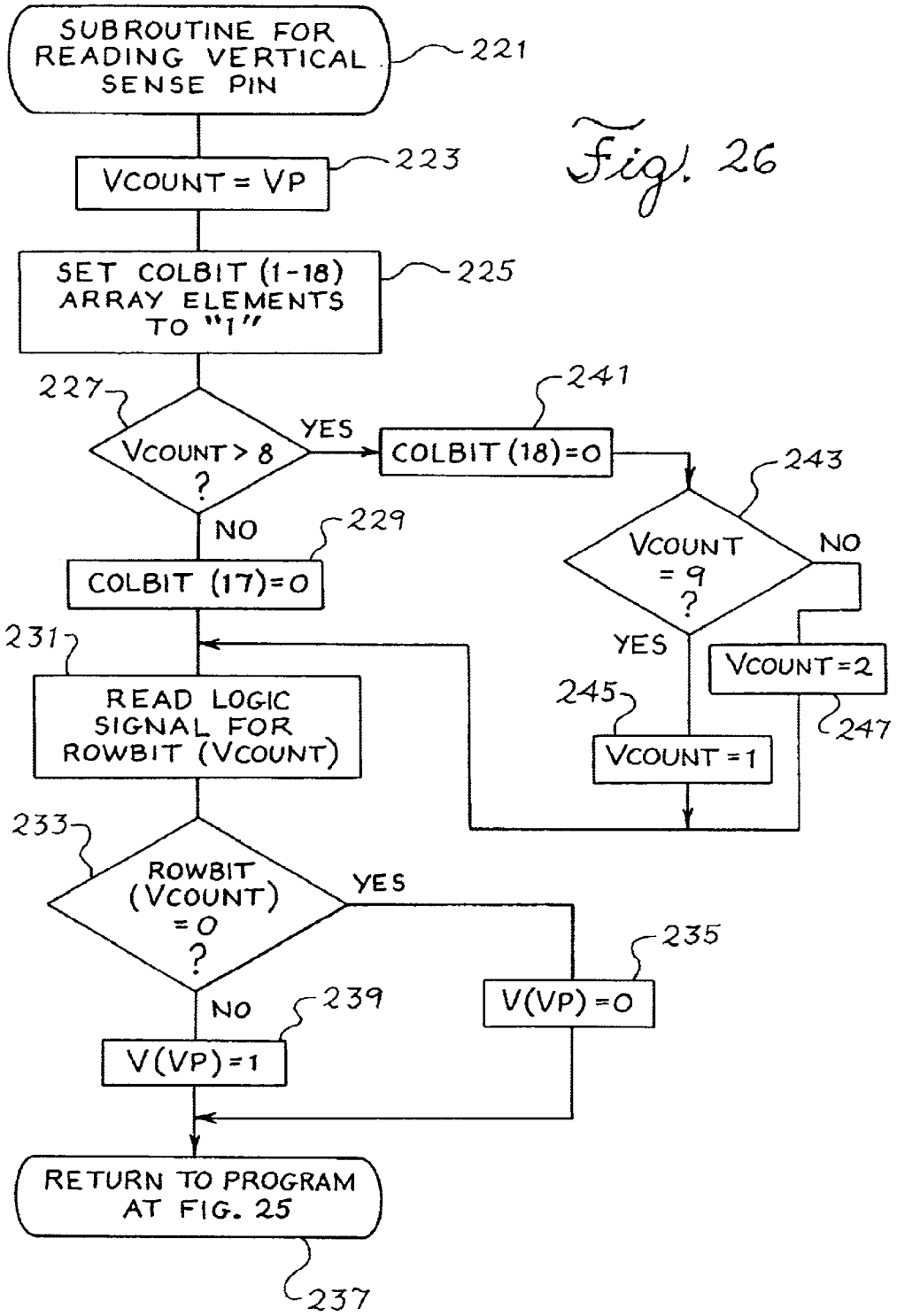
FIG. 26 is a flowchart of a subroutine of the program of FIG. 25 for reading vertical position switches.

With reference to FIG. 26, the subroutine for reading vertical position pins is accessed at 221 and a variable VCOUNT is set equal to the variable VP at 223. In the initial activation of the subroutine of FIG. 26, the variable VCOUNT is therefore set equal to 1. Thereafter, the column demultiplexer/decoder 222 of FIG. 24 is caused to set all of the column output lines 224, 226, 228, 230 and 232 to logic highs at step 225 of FIG. 26. The VCOUNT variable is then tested to determine if it is greater than 8. If VCOUNT is between 1 and 8 it is known that column 17 (line 230) of the demultiplexer/decoder of FIG. 24 must be accessed to determine the state of the associated V1–V8 switches. In order to access these switches, column 17 of the demultiplexer/decoder 222 of FIG. 24 is set to a low logic level at 229 of FIG. 26. The logic signal at the first row line 236 of FIG. 24 is read at 231 of FIG. 26 and is stored as an array variable ROWBIT(1). If the ROWBIT(1) variable is equal to 1 (i.e., if it is a logic high) at 233, then an array value V(1) is set to 1 at 239 to indicate that the corresponding V1 switch is open and therefore the pin V1 is actuated. It is known that the switch is open because, as previously discussed, a logic low signal on the column Line 230 will result in a corresponding high logic signal on the row line 236 if the V1 switch is open.

If ROWBIT(1) is 0 (i.e., a logic low) at 233, the array variable V(1) is set to 0 at 235 to indicate that a low logic level was detected at the row line 236 which indicates that the V1 vertical position switch is closed and therefore the pin V1 is not actuated. After the subroutine of FIG. 26 determines the state of the vertical position pin V1, program control is returned at 237 of FIG. 26 to the return point 188 of FIG. 25. The variable V(1) is then tested to determine if it is a 1 or 0. If the variable is 0, the V1 vertical position switch was closed and therefore program control is looped back at 181 to again detect the foot present condition. If a foot is present, the subroutine of FIG. 26 is called again to sense the condition of the V1 vertical position switch. The variable V(1) is continually tested until it is determined at 249 of FIG. 25 that V(1) is 1 and therefore opening of the V1 switch and actuation of the vertical position pin V1 has been detected.

Figure 27:
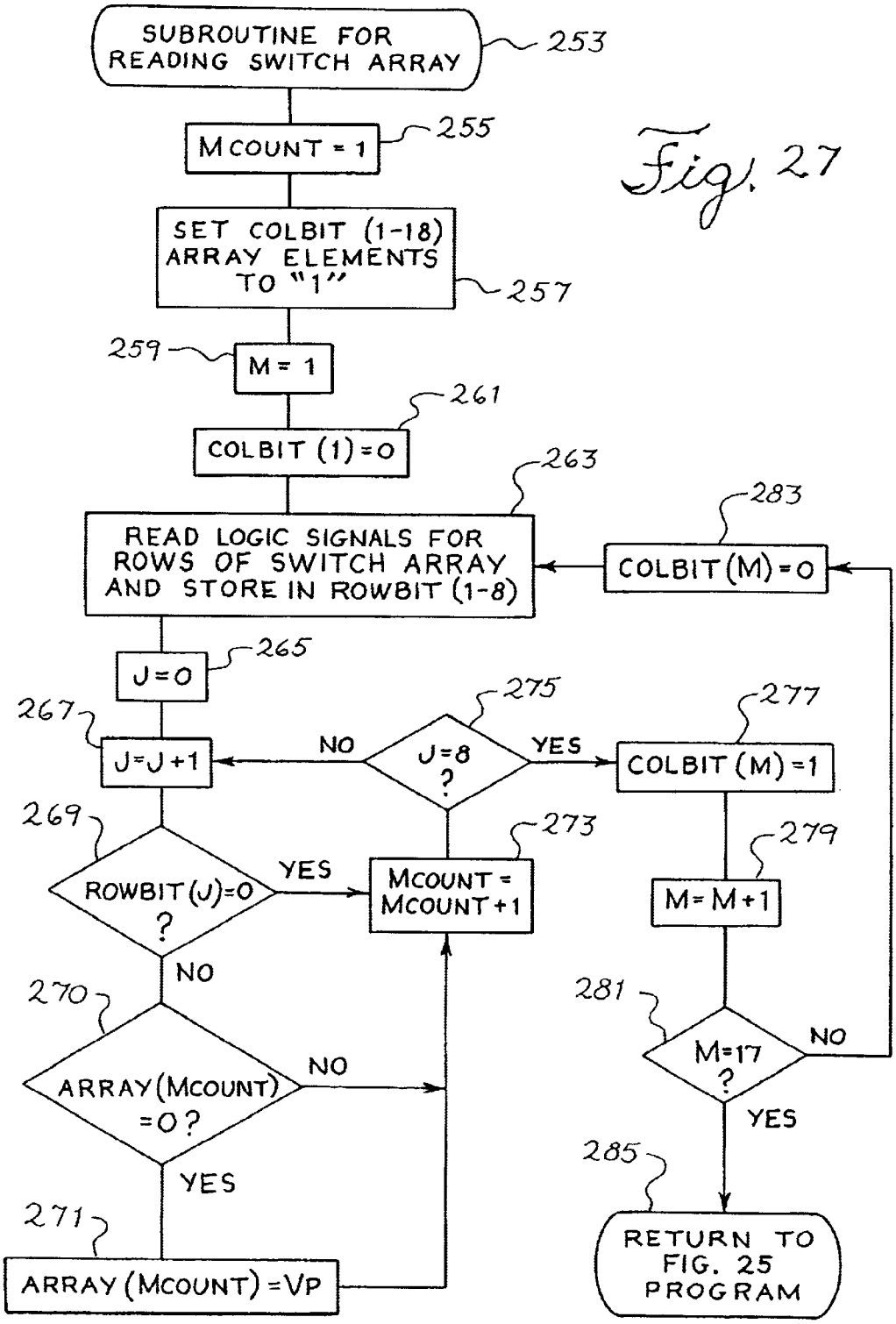
FIG. 27 is a flowchart of a subroutine of the program of FIG. 25 for reading a sensing switch array.

If actuation of the vertical position pin V1 is detected, a memory array is cleared at 251 and a subroutine of FIG. 27 is called at 252 to read the array of S1–S128 sensing switches. With reference to FIG. 27, the subroutine for reading the sense switch array is entered at 253 and a variable MCOUNT is set to 1 at 255. Thereafter the variables of the column bit array which correspond to the column lines of the demultiplexer/decoder 222 of FIG. 24 are set to logic highs at 257. A variable M is set to 1 at 259 and a logic low is set for the first column 224 of the demultiplexer/decoder by setting COLBIT(1) to 0 at 261. The logic signals for the 8 row lines, for example, 236, 238 and 240 of the multiplexer 234 of FIG. 24 are then read at step 263 of FIG. 27 and are stored in a corresponding ROWBIT array. A variable J is then set to 0 at 265 and is incremented to 1 at 267. The value of ROWBIT(1) is then tested at 269 and, if it is 0, it is known that the S1 sensing switch is closed and the S1 pin has therefore not been actuated. Program control is therefore passed to increment a counter at 273 and check the next switch S2. If the value of ROWBIT(1) is 1 at 269, the corresponding detected state of the S1 switch is "open", the S1 pin is actuated and therefore a variable ARRAY(1) is tested at 270. A value of 0 for this variable indicates that the S1 switch was not previously detected as actuated and, therefore, the variable ARRAY(1) is set at step 271 to a value of VP, which is 1 in this case. The value of VP for the array variable indicates that the S1 switch was actuated at or around the time that the vertical position pin V1 was actuated.

If the variable ARRAY(1) was determined to be non-0 at step 270, it would then be known that the S1 switch had been previously actuated and the subsequent actuation of this switch would therefore be ignored by passing program control to increment the counter MCOUNT at 273. However, in this case, the variable ARRAY(1) was equal to 0 and therefore the ARRAY(1) variable was set at 271 as previously described. Program control is then passed to the step 273 at which the variable MCOUNT is incremented by 1 to a value of 2. Program control is then passed to 275 to test the value of the variable J. At this point, J is less than 8 and therefore program control is transferred to 267 to increment J to the value of 2. Step 269 thereafter tests the logic signal of the second row 238 (FIG. 24) by checking the variable ROWBIT(2). If this variable is a logic high, the switch S2 is open (i.e., it is actuated) and therefore the variable ARRAY(2) is set to a VP value of 1 if the switch S2 was not previously detected as actuated. In this case, it is known that the switch S2 was not previously detected as actuated because this discussion concerns the first pass through the subroutine of FIG. 27. Program control is then returned to 273 to increment the MCOUNT variable. Thereafter, the program continues to loop through the described subroutine until all 8 lines of the multiplexer 234 of FIG. 24 have been tested. The array variables corresponding to the sense switches S1–S8 are set to a value of 1 if the corresponding switch is open and therefore indicates an actuated pin. The array variable for any switch that is closed and therefore not actuated remains equal to 0, because the memory array was previously cleared at step 251 of FIG. 25.

After all of the multiplexer rows have been tested, program control is transferred to the step 277 at which COLBIT (1) is set to a logic high. COLBIT(1) is set high because the scan of the first column of sense switches is complete. Thereafter the variable M is incremented at 279 and is tested at 281 to determine if all 16 switch columns of the demultiplexer/decoder have been scanned. At the stage of this discussion, the variable M is incremented to a value of 2 and therefore program control is transferred to a step 283 at which COLBIT(2) is set to 0. This causes the second column 226 of the demultiplexer/decoder 222 of FIG. 24 to be set to a logic low. Thereafter, the logic signals of the 8 rows of the multiplexer 234 of FIG. 24 are stored in the array variables ROWBIT(1)–(8) at 263 of FIG. 27. The program then continues as previously described to test the logic states of the rows and the associated operational states of the corresponding switches S9–S16 of the second column of the demultiplexer/decoder 222. ARRAY variables are set if the switches are actuated (i.e., open) and have not been previously detected as actuated. The ARRAY variables are unchanged if the switches are not actuated (i.e., closed).

The operation of the subroutine of FIG. 27 continues as described until all sense switches of the first 16 columns of the demultiplexer/decoder 222 of FIG. 24 have been checked. When all of the sense switches S1–S128 have been checked in relation to the actuation of the V1 vertical position switch, the test at step 281 of FIG. 27 indicates a value of 17 for the variable M. Program control is therefore returned at 285 of FIG. 27 to a return point 287 of FIG. 25. At this point, the initial vertical position pin V1 has been actuated and all of the sensing switches S1–S128 have been tested and their actuation status has been recorded.

Program control is then passed to the step 201 at which the variable VP is incremented to 2. The value of this variable is then tested at 203 and, since it is less than 11, the foot present condition is checked at 205. As previously discussed, the foot present condition is indicated by the state of the initial condition switch 57 of FIG. 24. If this switch indicates that the foot is not present, the microcontroller is put to sleep at step 179 and the sensing cycle is completed. If the foot is still present, the subroutine of FIG. 26 is then called at 289 of FIG. 25 to sense the state of the second vertical position pin V2.

With reference to FIG. 26, the subroutine operates as previously described to access column 17 (line 230) of the demultiplexer/decoder 222 of FIG. 24 in order to sense the condition of the V2 switch. Program control is then returned at step 237 of FIG. 26 to the return step 291 of FIG. 25. The condition of the V2 vertical position switch is then tested at 293 and, if the V2 switch was not actuated, the foot present switch 57 is checked at 205. If the foot is present, the program continues to loop and test the state of the vertical position pin V2 at 293. When this vertical position pin is actuated, the subroutine of FIG. 26 is called at 289. The subroutine of FIG. 26 detects the actuation of V2 as previously discussed by sensing a value of 1 for the ROWBIT(2) variable at 233. The variable V(2) is therefore set to 1 at 239 and program control is returned to 291 at FIG. 25. The variable V(2) is then tested at 293 and, since it is equal to 1, the subroutine of FIG. 27 is called at 252 to sense the conditions of all of the switches S1–128 corresponding to actuation of the second vertical sensing pin V2.

Thereafter, the subroutine of FIG. 26 is called by the program of FIG. 25 to sense the actuation of the remaining vertical position pins V3–V10. When each successive vertical pin V3–V10 is actuated, the subroutine of FIG. 27 is called to sense the states of the S1–S128 switches at the time of actuation of that vertical position pin. This operation continues until all vertical position pins have been actuated and the corresponding states of the S1–S128 switches have been recorded.

The subroutine of FIG. 26 senses the condition of the vertical position switches at columns 17 and 18 (230 and 232) of the demultiplexer/decoder 222 of FIG. 24. Since the first 8 vertical position switches V1–V8 are connected on column 17, the subroutine of FIG. 26 tests the states of these switches by setting the COLBIT(17) variable to 0 at 229. This results in a low logic level on column 17 of the demultiplexer/decoder 222 of FIG. 24. The condition of the switches V1–V8 can then be detected by sensing the signals on the associated row lines of the multiplexer 234. When the vertical position switches V9 and V10 must be tested, a high logic signal is generated for the column line 230 and a low logic signal is applied at the column line 232. With reference to FIG. 26, testing of the switches V9 and V10 is indicated when the value of the variable VCOUNT is determined to be greater than 8 at step 227. In this instance, program control is passed to a step 241 at which the variable COLBIT(18) is set to 0. This causes a low logic level to be applied on the column line 232 (FIG. 24) so that the state of the switches V9 and V10 can be tested.

If the VCOUNT variable is equal to 9 at step 243, the value of VCOUNT is reassigned at 245 to a value of 1 and program control is returned to the step 231 at which the value of the variable ROWBIT(1) is tested. That is, if the state of the vertical position switch V9 must be tested, a logic low is set on the column 232 and the corresponding first row 236 of the multiplexer 234 is checked by examining the state of the variable ROWBIT(1). If the value of VCOUNT at step 243 of FIG. 26 is 10, then the switch V10 must be tested by resetting the variable VCOUNT to 2 at step 247. Thereafter program control is transferred to step 231 to check the logic signal for the second line 238 of the multiplexer 234 which corresponds to the variable ROWBIT (2). The subroutine of FIG. 26 operates as previously described to return a value of 1 or 0 for the variables V(9) or V(10) to indicate the state of either of the V9 or V10 switches.

The control system for the contour sensor of FIG. 24 can be mounted on a single printed circuit board. The electrically conductive columns and rows of the sensing switch matrix are disposed as conducting traces on the board. For example, the conducting column traces are disposed on the top surface of the board and the conducting row lines are disposed as conductive traces on the back surface of the board. A voltage Vc bus is disposed on the front surface of the board adjacent to the column traces. The resistor and diode components are electrically connected on the front surface of the board, for example by solder, to corresponding connection points on the row and column traces. The resistors are connected at one end to the Vc power bus at the front of the board. The other end of each resistor connects through a hole to its associated row trace at the back of the board. The diodes are connected to their associated columns on the front of the board and to associated switch contacts also on the front of the board. The row contacts of each switch are disposed on the front of the board and connect through a hole to the associated row on the back of the board. The back of the board is mounted against the previously described surface 15 (FIG. 5) of the housing for the contour sensor and the sensing and vertical position pins extend through holes in the board and press against contacts at the front of the board as previously described.

The demultiplexer/decoder 222 and row multiplexer 234 are mounted on the periphery of the printed circuit board and connected to the corresponding column and row traces in a known manner. The microcontroller 169 is also mounted at the periphery of the circuit board and connected with the multiplexer and demultiplexer/decoder as shown in FIG. 24. The connections can be provided by conductive traces disposed, for example, on the front or back side of the printed circuit board. The initial condition switch 57 is disposed off of the printed circuit board as previously described and connects with the printed circuit board, for example, by flexible wires. Other methods of construction of the control circuit of FIG. 24 could be used without departing from the spirit of the invention.

The device described with respect to FIGS. 24–27 is preferred at this time because it is relatively inexpensive and can be implemented with battery power. This device would be particularly effective for use in the home or in retail shoe outlets. The data from the device could be easily transmitted over the Internet by a standard serial port connection. Accordingly, the device could communicate foot measurements or corresponding shoe size designations to a web site, for example, to allow a user to select and order shoes. Data would be stored at the site to keep track of the user's foot measurements and preferences for shoes. As used herein and in the claims, any reference to the size of the foot refers to the dimensions of the foot as well as the corresponding shoe size. This database would be particularly useful for obtaining shoes for children. The database would also allow users to obtain suggestions for shoes based upon purchases made by others who have a similar size. The database could also be accessed to allow a gift giver to purchase shoes based upon the size and preferences listed for a particular individual.

Variations and modifications of the embodiments disclosed herein may be made without departing from the scope and spirit of the invention. For example, the described system and method for sensing contour data could be implemented with many different types of sensing pins and with apparatus that controls the descent of the foot to the pins, for example by hydraulic mechanisms, or that raises the pins, for example by stepping motors, to meet the surface of the foot. The system could scan the feet of a user simultaneously or one foot at a time. The system could also be used to sense the size and shape of the hand as an aid in selecting gloves. The disclosed system can also be used to sense the surface contour of any animate or inanimate object. Apparatus could also be employed to sense a surface contour from the side or from the interior of an object such as a shoe. As a further example, the housing of the foot sensor could be made of a solid block of rigid material such as metal or plastic with holes drilled in the block to support the pins in relation to a top cover containing an overlying printed circuit board as previously described.

The invention is also not limited to the use of resilient bias members such as springs or foam elements. Other biasing systems could be employed. For example, sensing pins could be resiliently supported by an air bladder or by fluid pressure systems. Sensing pins could also be actuated in response to a change in capacitance, pressure, resistance or any change resulting from contact with the sensed object. For example, detector plates could be supported in stacked relation in parallel planes. Pins with axial resistance or capacitance characteristics could be disposed to pass through aligned holes in the plates and changes in capacitance or resistance would then indicate movement of the pins. The sensing pins can also be provided in any lengths or sizes without departing from the invention. Sensing pin switches could also be operated in a normally open mode or could have axially displaced, momentary switch contacts.

It should also be understood that the invention encompasses a contour sensing apparatus with relative movement between a surface contour and sensing pins. In such a system, the pins and pin support could move relative to a stationary object or object support, the object or object support could move relative to stationary pins, or the pins and object could move together. The stored values that determine the relative displacements of the pins can be obtained by detecting the displacement of the object, pins or both of them relative to a zero reference plane or planes, or by measuring the decreasing distance between the surface of the object and the support for the pins.

Measurements of displacement or distance may be made by any means known in the art. For example, the displacement of the object or pins could be directly measured or electrical pulses could be counted as described. Additionally, if relative vertical movement is provided by a stepping motor, stepping pulses for the motor could be counted for pin actuations or the motor could be run at a fixed rate and the time of actuation of each sensing pin could be recorded to indicate its relative displacement. The aforementioned described embodiments are therefore intended to be illustrative rather than limiting and it should be understood that the following claims and their equivalents set forth the scope of the invention.

What is claimed is:

1. A method for sensing the contour of a surface of a human extremity, comprising the steps of:

providing a plurality of surface sensing pins;

mounting said pins on a support with their free ends disposed in a sensing plane and biased against axial movement from their extended positions;

causing relative movement between the support and said surface so that the pins press against the surface;

detecting when the end of each sensing pin contacts said surface and storing a point contact contour value for the pin indicating the amount of relative movement between said support and said surface required to achieve the point of contact; and allowing each pin to be deflected and independently move axially against said bias force as the surface continues to press against the pin, whereby the surface contour is detected without sensing the magnitude of deflection of each pin with multiple movement detectors or separate movement measurements.

2. The method of claim 1, further including the steps of:

providing a human foot as the extremity; and pressing a surface of the foot against the ends of said pins.

3. The method of claim 1, further including the steps of:

providing a human foot as the extremity; and pressing the bottom surface of the foot against the ends of said pins.

4. The method of claim 1, further including the steps of:

providing a human foot as the extremity;

providing a movable support plate disposed at a rest position above said sensing plane and having holes aligned with the ends of said pins; and pressing the bottom surface of the foot against the support plate and downward so that the ends of the pins engage and press against the bottom surface of the foot through said holes.

5. The method of claim 4, further including the step of resiliently biasing the support plate against downward movement toward the ends of the pins.

6. The method of claim 4, wherein said step of detecting includes the step of measuring the displacement of said support plate from a predefined zero reference position to indicate the amount of movement required to achieve the contact.

7. The method of claim 6, further including the step of defining the sensing plane as the zero reference position of the support plate.

8. The method of claim 4, wherein said step of detecting further includes the steps of:

generating an electrical signal for each decremental movement of the support plate from the sensing plane and toward the support for the pins;

counting each such signal; and storing the count as a point contour value for each pin when the pin contacts the surface of the foot.

9. The method of claim 8, further including the steps of:

providing a plurality of actuating pins diminishing in size; and successively actuating these pins and generating said electrical signals in response to movement of the support plate toward the support for the pins.

10. The method of claim 4, further including the step of using coil springs to bias said pins in extended vertical orientation to said support.

11. The method of claim 4, further including the step of using resilient foam to bias said pins in extended vertical orientation to said support.

12. The method of claim 4, further including the step of orienting the ends of the sensing pins downward and using the force of gravity to bias the pins to their fully extended position.

13. The method of claim 4, wherein said step of detecting further includes the step of measuring the distance between the support for the pins and the support plate to indicate the amount of movement required to achieve the contact.

14. The method of claim 4, wherein said step of detecting includes the step of activating a switch associated with each pin when the end of the pin initially contacts said surface and is moved axially.

15. The method of claim 4, wherein said step of detecting includes the steps of:

providing an electrically conducting cover for the contact surface of said foot;

providing electrically conductive sensing pins;

energizing the pins;

grounding the cover; and sensing an electrical signal that occurs when each energized pin contacts the cover.

16. The method of claim 1, wherein said step of detecting includes the step of activating a switch associated with each pin when the end of the pin initially contacts said surface and is moved axially.

17. The method of claim 1, wherein said step of detecting includes the steps of:

providing an electrically conducting cover for the contact surface of said object;

providing electrically conductive sensing pins;

energizing the pins;

grounding the cover; and sensing an electrical signal that occurs when each energized pin contacts the cover.

18. The method of claim 1, wherein said step of detecting further includes the steps of:

generating an electrical signal for each relative decremental movement between the surface of the object and the support for the pins;

counting each such signal; and storing the count as a point contour value for each pin when the pin contacts the surface of the extremity.

19. The method of claim 18, further including the steps of:

providing a plurality of actuating pins diminishing in size; and successively actuating these pins and generating said electrical signals in response to the relative decremental movement of the surface of the object and the support of the pins.

20. The method of claim 1, further including the steps of:

providing a stationary support plate supporting the surface of the extremity above the sensing pins and having holes aligned with the ends of the pins; and moving said pin support upward toward said support plate so that the ends of the pins engage and press against the surface of the extremity through said holes.

21. The method of claim 20, wherein said step of detecting further includes the step of measuring the displacement of the pin support from a predefined zero reference position to indicate the amount of movement required to achieve the contact.

22. The method of claim 1, further including the step of displaying the point contact contour values of the pins to provide an image of said extremity.

23. The method of claim 1, further including the steps of:

using the human foot as the extremity; and displaying the point contact contour values of the pins to provide an image of the contour of the foot.

24. The method of claim 1, further including the steps of:

using the human foot as the extremity; and analyzing said point contact contour values of the pins to determine the physical dimensions of the foot.

25. The method of claim 1, further including the steps of:

using the human foot as the extremity; and analyzing said point contact contour values of the pins to select at least one shoe that will fit the foot.

26. The method of claim 1, further including the steps of:

using a human foot as the extremity; and applying said point contact contour values of the pins to manufacture an insole contoured to fit and support the foot.

27. The method of claim 1, further including the steps of:

using a human foot as the extremity; and applying said point contact contour values of the pins to manufacture a shoe to fit and support the foot.

28. A method for sensing the contour of a surface of a human extremity, comprising the steps of:

providing a plurality of upstanding sensing pins biased against axial movement with the ends of the pins arranged in a plane;

engaging the ends of the pins with said surface by decreasing the distance between the plane of all of the pins and the surface; and storing a value corresponding to the magnitude of relative movement required to achieve the decreasing distance when each pin contacts a point on the surface at said plane.

29. A method for sensing the contour of a surface of a human extremity, comprising the steps of:

providing a plurality of upstanding sensing pins biased against axial movement with the ends of the pins arranged in a plane;

engaging the ends of the pins with said surface by movement decreasing the distance between the plane of all of the pins and the surface; and storing a value corresponding to the amount of relative movement required to cause each pin to contact a point on the surface at said plane.

30. The method of claim 29, further including the step of using the stored displacement values to determine the size and contour of the surface of the foot.

31. The method of claim 29, further including the step of using the stored displacement values to select one or more shoes that will fit the foot.

32. The method of claim 29, further including the step of using the stored displacement values to manufacture an insole shaped to the contour of the underside of the foot.

33. The method of claim 29, further including the step of using the stored displacement values to manufacture a shoe shaped to the contour of the foot.

34. The method of claim 29, further including the step of obtaining stored displacement values for the underside of the foot and the instep of the foot and using this information to define the shape of the top and bottom of the foot.

35. An apparatus for sensing the contour of a surface of a human extremity, comprising:

a base for holding a plurality of upstanding sensing pins biased against axial movement;

means for moving to decrease the distance between the surface and said base so that the ends of the pins engage points on said surface as the surface contacts the pins;

means for counting predefined increments of said movement; and means for storing the value of the count of said increments of movement for each pin at the time the pin contacts the surface, the counts for said pins defining the sensed contour of the surface.

36. The sensing apparatus of claim 35, further including means for setting a maximum count value for all pins that do not contact said surface.

37. The sensing apparatus of claim 35, wherein said means for counting includes a counter.

38. The sensing apparatus of claim 35, wherein said means for counting includes a microcontroller.

39. The sensing apparatus of claim 35, wherein said means for storing includes a random access memory.

40. The sensing apparatus of claim 35, wherein said base includes a coil spring for biasing each sensing pin against axial movement away from the surface.

41. The sensing apparatus of claim 35, wherein said base includes resilient foam for biasing each sensing pin against axial movement away from the surface.

42. The sensing apparatus of claim 35, wherein said pins are biased against axial movement by the force of gravity.

43. The sensing apparatus of claim 35, wherein said means for moving is a plate for engaging the surface, the plate having holes aligned with the ends of said pins so that the ends of the pins pass through the holes and engage the surface adjacent to the plate as the surface and plate move toward the pins.

44. The sensing apparatus of claim 43, including means for resiliently biasing said plate against movement toward the ends of said pins.

45. The sensing apparatus of clam 35, wherein said extremity is the human foot.

46. A foot contour sensing apparatus comprising:

a base for holding an array of upstanding sensing pins biased against axial movement;

a plate disposed above the ends of said pins for supporting a human foot, the plate having holes aligned with the ends of said sensing pins and being resiliently biased against axial movement toward the pins;

means for counting predefined increments of movement of the plate as the foot presses the plate downward toward the pins, the pins passing through the holes in the plate and engaging the undersurface of the foot as the plate is pressed down; and means for storing the value of the count of said increments to indicate the position of the plate for each pin at the time the pin contacts the undersurface of the foot, the stored counts for the pins defining the sensed contour of the undersurface of the foot.

47. The contour sensing apparatus of claim 46, wherein each of said pins includes switching means for generating an electrical signal that indicates the initial contact of the end of the pin with the undersurface of the foot.

48. The contour sensing apparatus of claim 47, wherein said switching means includes a switch that generates a first electrical signal when the pin is in its upright position out of contact with the surface of the foot and a second electrical signal when the pin is moved axially by pressing contact with the surface of the foot, said second signal indicating contact of the pin and foot.

49. The contour sensing apparatus of claim 47, wherein said switching means includes a grounded electrically conducting cover for the undersurface of the foot and an electrically conducting energized pin, the pin generating said electrical signal when it contacts said conducting cover.

50. A foot contour sensing apparatus, comprising:

a base for holding an array of sensing pins biased against axial movement;

means for reducing the distance between the base and a surface of a foot so that the ends of the pins move toward and engage the surface;

means for counting incremental changes in the diminishing distance as the ends of the pins move to contact the surface of the foot; and means for storing the value of a count of said incremental changes at the time each pin contacts the surface of the foot, the stored counts for the pins defining the sensed contour of the surface of the foot.

51. The contour sensing apparatus of claim 50, wherein the base is disposed so that the force of gravity biases the pins against axial movement and the pins engage the top surface of the foot.

52. The contour sensing apparatus of claim 50, wherein the base is disposed so that the ends of the pins face downwardly and press against the top surface of the foot, the pins being biased downwardly by resilient spring elements.

53. A method for sensing the contour of a surface of the human foot, comprising the steps of:

providing a support for a plurality of sensing pins, each pin having a switch that generates an electrical pin actuation signal when the pin contacts a surface of the foot;

counting fixed decrements in the distance between the support and the surface of the foot as the pins move toward the surface of the foot; and storing the count that occurs at the time each pin generates said electrical pin actuation signal.

54. A method for sensing the contour of a surface of a human extremity, comprising the steps of:

providing a support for a plurality of sensing pins, each pin having a switch that generates an electrical pin actuation signal when the pin contacts said surface;

generating an electrical count signal for each fixed decrement in the distance between the support and the surface as the pins move toward the surface;

multiplexing the pin actuation signals for input to a microcontroller;

applying to the microcontroller said electrical count signals that indicate the position of the support relative to the surface; and using the microcontroller to count the electrical count signals and store the count that occurs at the time that each pin generates its multiplexed pin actuation signal.

55. The method of claim 54, wherein said step of using the microcontroller includes the steps of:

incrementing the count when each count signal is received;

checking the status of the multiplexed pin actuation signals for all sensing pins; and storing the incremented count value for any pins that have active pin actuation signals.

56. The method of claim 55, further including the step of storing a predefined maximum count for all pins that are not actuated.

57. The method of claim 54, further including the step of providing a human foot as the extremity.

58. The method of claim 57, further including the step of selecting shoes that are compatible with said stored counts.

59. The method of claim 57, further including the steps of:

creating a database that includes information concerning the foot measurements and shoe purchases for a plurality of people;

determining from the database the shoe purchases of persons having foot measurements similar to the foot measurements detected for a particular person; and selecting shoes for said particular person compatible with said shoe purchases of persons having similar foot measurements.

60. The method of claim 57, further including the steps of:

creating a database that includes information concerning the foot measurements and shoe purchases for a plurality of people;

determining from the database the shoe purchases and foot measurements of a particular person; and selecting shoes for said particular person compatible with the shoe purchases and foot measurements for that person.

61. The method of claim 54, further including the step of sensing the contour of an interior surface of a shoe.

62. A method for selecting shoes, comprising the steps of:

providing a plurality of sensing pins;

mounting said pins on a support with their free ends disposed in a sensing plane and biased against axial movement from their extended positions;

moving at least one human foot and the sensing pins toward each other;

detecting the relative movement required for the end of each pin to contact the foot;

storing the magnitude of the detected relative movements for the sensing pins that contact said foot; allowing each pin to be deflected and independently move axially against said bias as the foot continues to press against the pin; and deriving information concerning the size of said foot from said stored magnitudes of relative movements.

63. The method of claim 62, further including the step of selecting shoes compatible with the derived size of said at least one foot.

64. The method of claim 62, further including the step of selecting shoes compatible with the derived sizes of a person's two feet.

65. The method of claim 62, further including the steps of:

creating a database that includes information concerning the foot sizes and shoe purchases of a plurality of people;

determining from the database the shoe purchases of persons having foot sizes similar to the foot sizes derived for a particular person; and selecting shoes for said particular person compatible with the shoe purchases of persons having similar foot sizes.

66. The method of claim 62, further including the steps of:

creating a database that includes information concerning the foot sizes and shoe purchases of a plurality of people;

determining from the database the shoe purchases and foot sizes of a particular person; and selecting shoes for said particular person compatible with the foot sizes and shoe purchases for that person.

67. The method of claim 62, further including the step of sensing the contour of an interior surface of a shoe.

68. The method of claim 62, further including the step of accessing stored information concerning shoes and selecting at least one shoe that will fit said foot.

69. The method of claim 62, further including the step of using the Internet to access information concerning shoes and selecting at least one shoe that will fit said foot.

70. A method for sensing a contour of a surface of a human extremity, comprising the steps of:

providing a plurality of sensing pins retained as a unit;

providing a switch for each pin arranged in a matrix of addressable rows and columns;

actuating the switch for each pin when the pin contacts said surface;

matrix addressing said switches;

reading the actuation state of each switch;

detecting the displacement of said unit relative to said surface when each switch is actuated;

storing the relative displacement of the unit for the sensing pins with actuated switches; and deriving information concerning the contour of said surface from said stored relative displacements.

71. The method of claim 70, further comprising the step of reading the actuation state of each switch when a predetermined voltage signal is applied to an addressable matrix line that includes the switch.

72. The method of claim 70, further comprising the steps of providing a diode for each switch and forward biasing each diode to read the actuation state of its switch when a predetermined voltage signal is applied to an addressable matrix line that includes the switch.

* * * * *